US012429306B2

(12) United States Patent
Enzinger

(10) Patent No.: US 12,429,306 B2
(45) Date of Patent: Sep. 30, 2025

(54) ENGAGEMENT LOCK FOR TOOL-LESS RE-ZERO ADJUSTMENT KNOB

(71) Applicant: Leupold & Stevens, Inc., Beaverton, OR (US)

(72) Inventor: Kyle Edward Enzinger, Newberg, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 18/644,872

(22) Filed: Apr. 24, 2024

(65) Prior Publication Data

US 2024/0271907 A1 Aug. 15, 2024

Related U.S. Application Data

(60) Continuation-in-part of application No. 18/405,945, filed on Jan. 5, 2024, now Pat. No. 12,173,987, which is a division of application No. 17/650,247, filed on Feb. 7, 2022, now Pat. No. 11,906,268, which is a continuation-in-part of application No. 16/803,881, filed on Feb. 27, 2020, now Pat. No. 11,243,049.

(60) Provisional application No. 62/811,022, filed on Feb. 27, 2019.

(51) Int. Cl.
*F41G 1/38* (2006.01)

(52) U.S. Cl.
CPC ..... *F41G 1/38* (2013.01)

(58) Field of Classification Search
CPC .... G02B 23/16; G02B 23/2476; G02B 26/08; G02B 26/0833; G02B 27/00; G02B 27/36; G02B 27/0056; F41G 1/38; F41G 1/42
See application file for complete search history.

(56) References Cited

U.S. PATENT DOCUMENTS 4,012,966 A * 3/1977 Lieberman ..... G05G 1/10 464/36
5,513,440 A * 5/1996 Murg ..... F41G 1/26 33/298
6,279,259 B1 * 8/2001 Otteman ..... F41G 1/38 42/122
8,006,429 B2 * 8/2011 Windauer ..... F41G 3/06 42/122
8,490,317 B2 * 7/2013 Adkins ..... F41G 1/38 42/135

(Continued)

*Primary Examiner* — Michael D David
(74) *Attorney, Agent, or Firm* — Schwabe, Williamson & Wyatt, P.C.

(57) ABSTRACT

Various embodiments described herein may include a turret assembly comprising: first and second rotatable parts to co-rotate to change the optic device setting; a first user interface actuatable to select a mode of operation of a plurality of different modes of operation including an engaged mode of operation when the first rotatable part is engaged with the second rotatable part to enable co-rotation and a non-engaged mode of operation when the first rotatable part is rotatable relative to the second rotatable part; the turret assembly further including an engagement lock settable in a plurality of states including: a locked state that restricts actuation of the first user interface; and an unlocked state that releases the restriction; and a second user interface comprising a button or other lock release actuatable to select between the locked and unlocked states. Other embodiments may be disclosed and/or claimed.

20 Claims, 21 Drawing Sheets

(56) References Cited

U.S. PATENT DOCUMENTS

| | | | | |
|---|---|---|---|---|
| 8,806,798 | B2 * | 8/2014 | Crispin | F41G 1/38 74/553 |
| 9,170,068 | B2 * | 10/2015 | Crispin | F41G 1/38 |
| 11,243,049 | B1 * | 2/2022 | Enzinger | G02B 27/36 |
| 2007/0240356 | A1 * | 10/2007 | Klepp | G02B 23/00 42/122 |
| 2008/0066364 | A1 * | 3/2008 | Klepp | F41G 1/38 42/122 |
| 2011/0061285 | A1 | 3/2011 | Hamilton | |
| 2011/0100152 | A1 * | 5/2011 | Huynh | F41G 1/22 74/504 |
| 2011/0261449 | A1 * | 10/2011 | Schmitt | G02B 27/36 359/428 |
| 2014/0237884 | A1 * | 8/2014 | Koesler | F41G 1/345 42/111 |
| 2016/0040959 | A1 * | 2/2016 | Davidson | F41G 1/38 42/122 |
| 2016/0169672 | A1 | 6/2016 | Öttl et al. | |
| 2016/0370146 | A1 | 12/2016 | Hamilton | |
| 2017/0191797 | A1 | 7/2017 | Lassak et al. | |
| 2017/0226806 | A1 * | 8/2017 | Nguyen | E21B 7/24 |
| 2018/0292171 | A1 | 10/2018 | Hamilton | |
| 2019/0310052 | A1 | 10/2019 | Krausz | |
| 2019/0376765 | A1 | 12/2019 | Hamilton | |
| 2020/0326155 | A1 * | 10/2020 | Hamilton | G02B 23/14 |
| 2023/0134361 | A1 * | 5/2023 | Enzinger | F41G 1/38 42/122 |

* cited by examiner

ENGAGEMENT LOCK FOR TOOL-LESS RE-ZERO ADJUSTMENT KNOB

RELATED APPLICATION

This application is a continuation-in-part of U.S. patent application Ser. No. 18/405,945, filed Jan. 5, 2024, which is a divisional of U.S. patent application Ser. No. 17/650,247, filed Feb. 7, 2022, now U.S. Pat. No. 11,906,268, which is a continuation-in-part under 35 U.S.C. § 120 of U.S. patent application Ser. No. 16/803,881, filed Feb. 27, 2020, now U.S. Pat. No. 11,243,049, which claims the benefit under 35 U.S.C. § 119(e) of U.S. Provisional Patent Application No. 62/811,022, filed Feb. 27, 2019, each of which are herein incorporated by reference in their entirety.

TECHNICAL FIELD

The present disclosure generally relates to optical devices, including rifle scopes and other ranged device optics, and other optical devices, and more particularly, adjustment turret knobs for aiming devices that can be re-zeroed without the use of tools, and to ranged device optics or other optical devices including such adjustment knobs.

BACKGROUND

A scope for a ranged device such as a firearm may require adjustment when targeted on an object. For example, because a projectile may fall or otherwise have its course changed by environmental factors as it travels, the aim of the scope may be adjusted vertically and/or horizontally to compensate for such effects and increase the likelihood that an object located in crosshairs of the scope will be impacted by the bullet. Vertical adjustment of the scope's aim is known as elevation adjustment because it compensates for a projectile's elevation change (e.g., falling), and horizontal adjustment of the scope's aim is known as windage adjustment because it compensates for sideways movement of a projectile, which is often caused by wind.

The horizontal and vertical adjustment of the aim can be accomplished by manually rotating turret knobs on the scope that adjust the position of lenses or other optical elements inside the scope. An indicator scale comprising a set of markings on the outside of the knob provides a visual indication of the amount of rotation of the knob. In some adjustment knobs, the position of the indicator scale can be adjusted relative to the setting of the knob by using a hex key to loosen a grub screw coupling a dial of the knob to a rotatable threaded member inside of the knob, as is taught for example in U.S. Pat. No. 9,170,068 of Crispin, which is incorporated herein by reference. After the grub screw is loosened, the dial can be rotated to the desired position to adjust a zero setting of the knob, then the grub screw is re-tightened to fix the dial to the threaded member for co-rotation. By "zeroing" the elevation and/or windage knob in this manner, the shooter may ensure that the scope is properly calibrated (or "sighted-in") for aiming the firearm at an object at a particular distance. Sighting-in a riflescope at a known distance facilitates accurate aiming adjustments for other distances or environmental conditions, relative to the calibrated setting.

U.S. Pat. No. 6,279,259 of Otteman and U.S. Pat. No. 5,513,440 of Murg disclose riflescope adjustment mechanisms that can be re-zeroed without the use of tools. In each case, a dial portion of the adjustment mechanism is movable axially relative to inner threaded member. When the dial portion is pushed axially inward into engagement with the threaded member, the dial and threaded member rotate together to accomplish aiming adjustments. When the dial portion is pulled axially outward it can be rotated relative to the threaded member to re-set a zero setting of an indicator scale of the adjustment mechanism.

The present inventor has recognized the need for improved systems and methods for re-zeroing optical scope adjustment mechanisms.

Additional aspects and advantages will be apparent from the following detailed description of preferred embodiments, which proceeds with reference to the accompanying drawings.

BRIEF DRAWINGS DESCRIPTION

The accompanying drawings, wherein like reference numerals represent like elements, are incorporated in and constitute a part of this specification and, together with the description, explain the advantages and principles of the presently disclosed technology.

FIG. 6A shows the elevation adjustment knob in an engaged position and the windage adjustment knob in a disengaged position, and FIG. 6B shows the opposite situation.

DETAILED DESCRIPTION

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
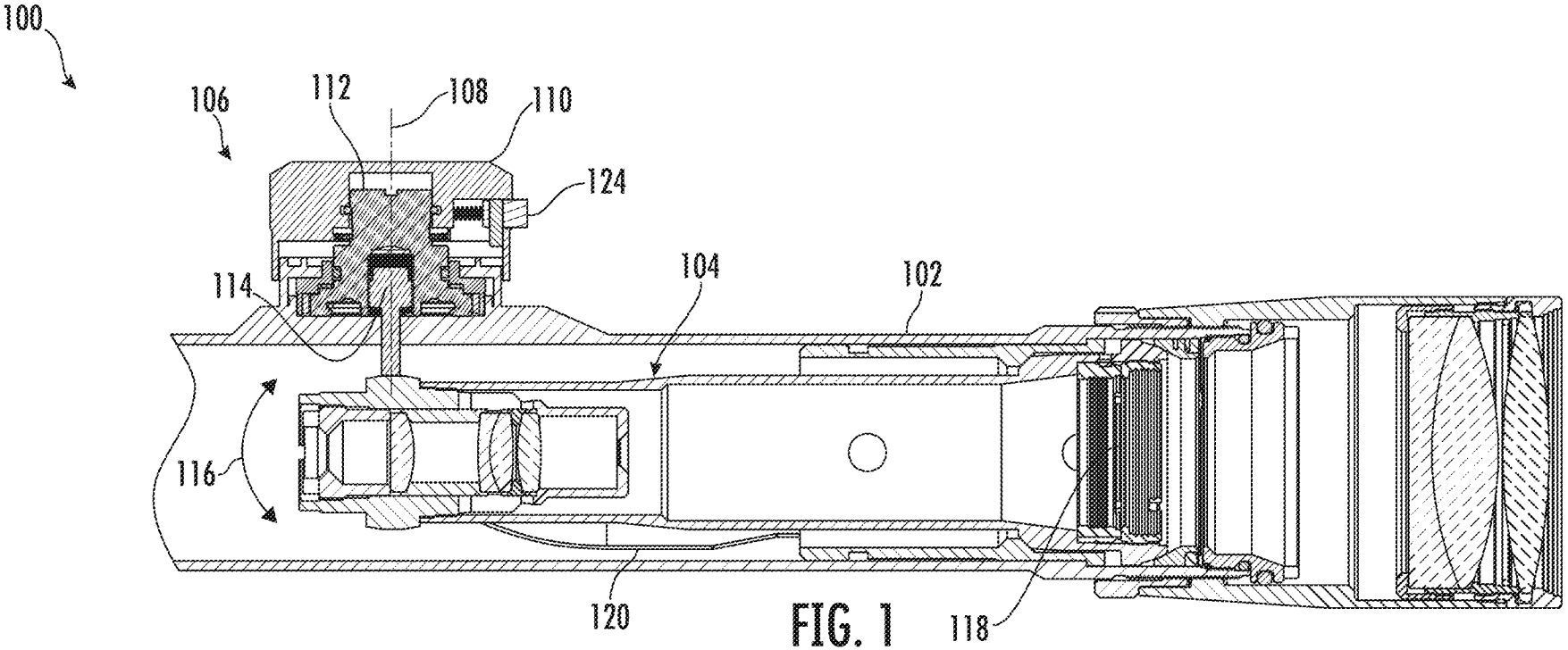
FIG. 1 is a partial cross-sectional view of a riflescope along a longitudinal axis showing an adjustment knob in a disengaged position.

FIG. 1 illustrates a cross-sectional view of a riflescope 100 along a longitudinal axis having a housing 102 (sometimes referred to as the "maintube") and an image-inverting erector system 104 pivotally mounted within the housing 102, where erector system 104 provides an image of a point of aim. An adjustment knob 106 protrudes from housing 102 and is rotatable about an axis 108 extending transversely to a longitudinal axis of the housing 102. In some embodiments, adjustment knob 106 is press fit onto housing 102. In other embodiments, adjustment knob is threaded onto housing 102. Although a presently preferred embodiment of a weapon aiming device is described herein as riflescope 100, adjustment knobs consistent with the present disclosure may also be used with other types of optical aiming devices, such as red-dot sights, reflex sights, holographic aiming sights, iron sights, and other devices for aiming weapons and other devices, and particularly those devices for which a user may wish to adjust a zero or home position of the aiming device.

Figure 2:
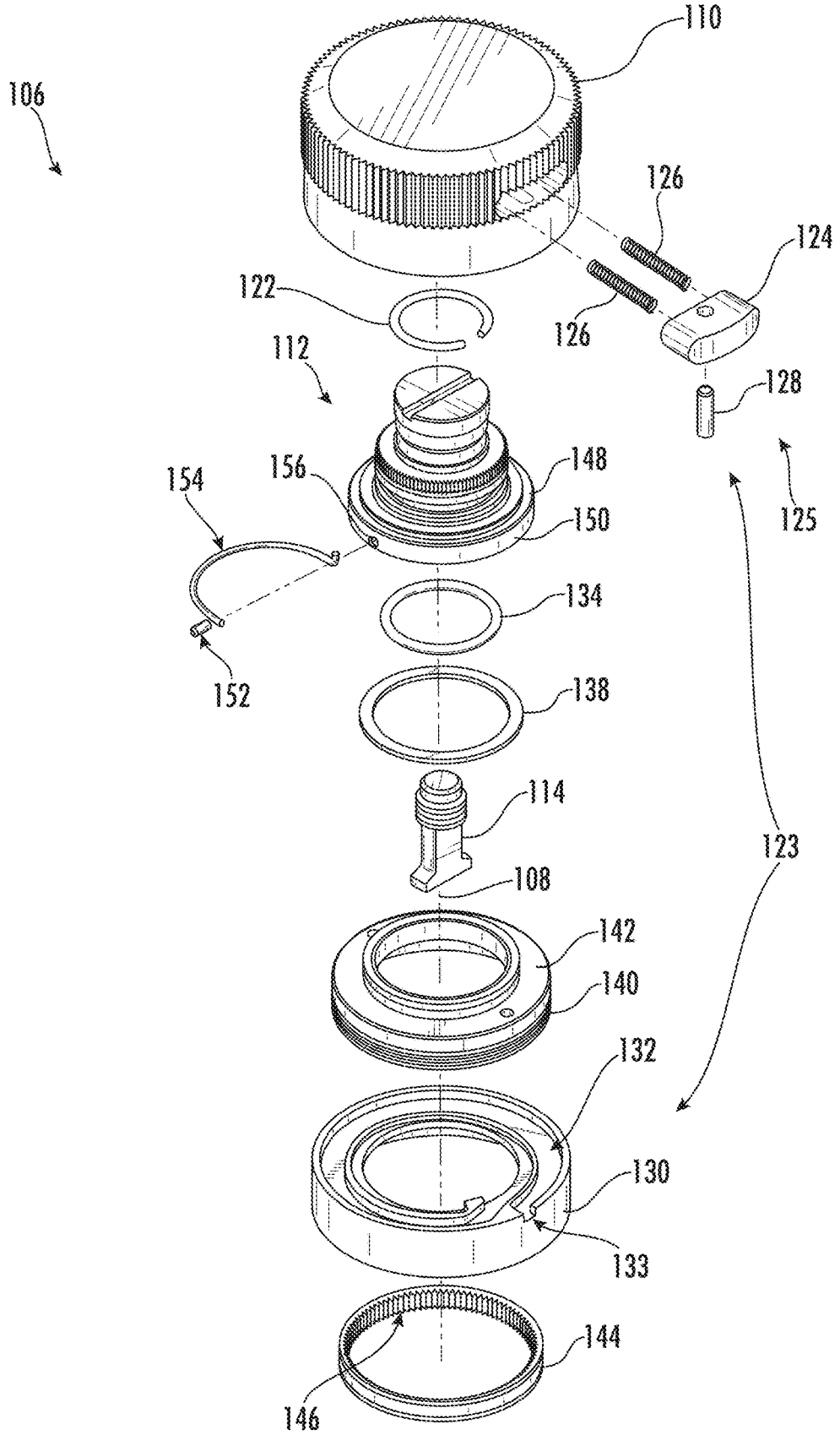
FIG. 2 is an exploded isometric view of the adjustment knob of FIG. 1.
Figure 3:
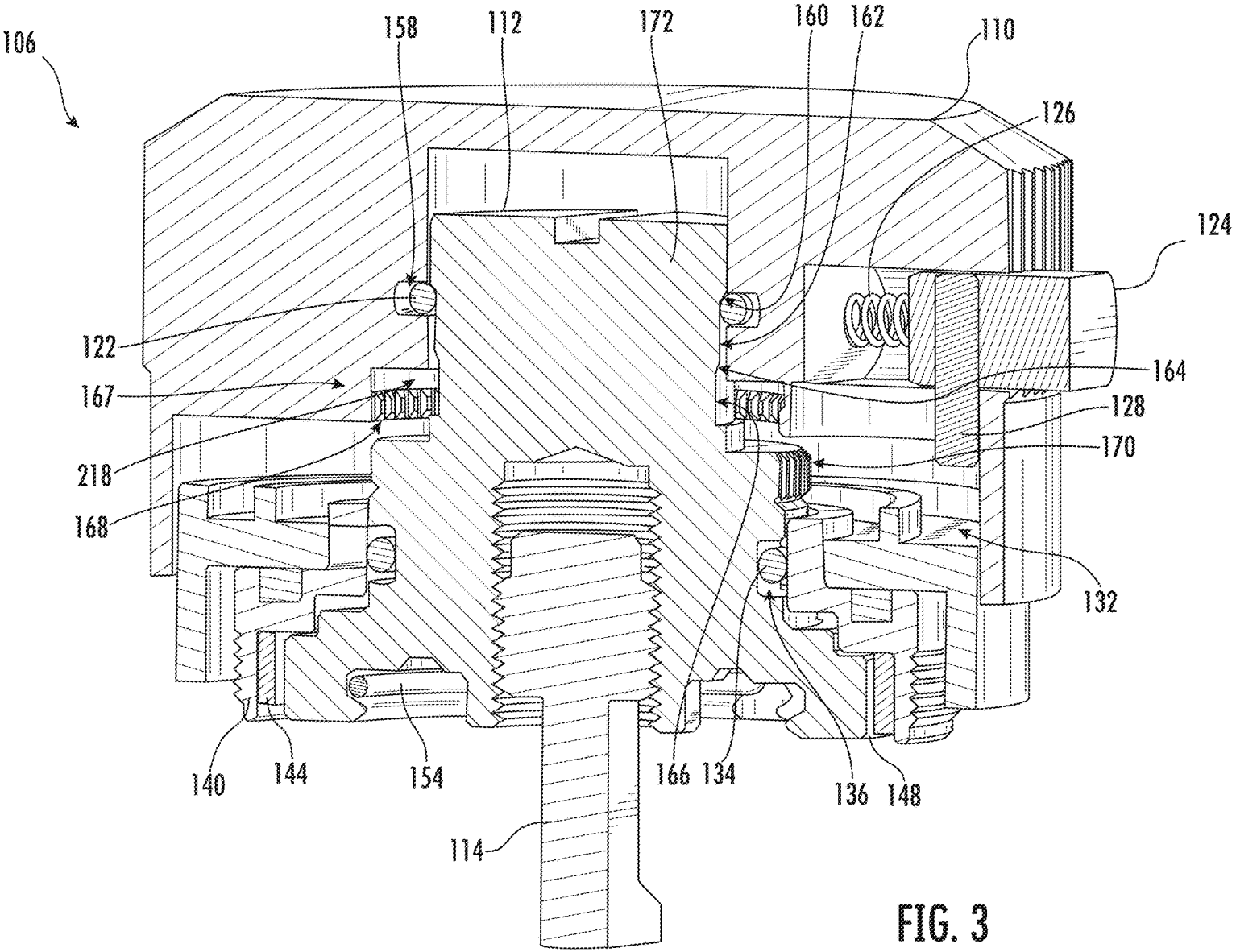
FIG. 3 is an enlarged isometric cross-sectional view of the adjustment knob of FIG. 1 showing a dial of the knob disengaged from a rotating member of the knob.
Figure 5:
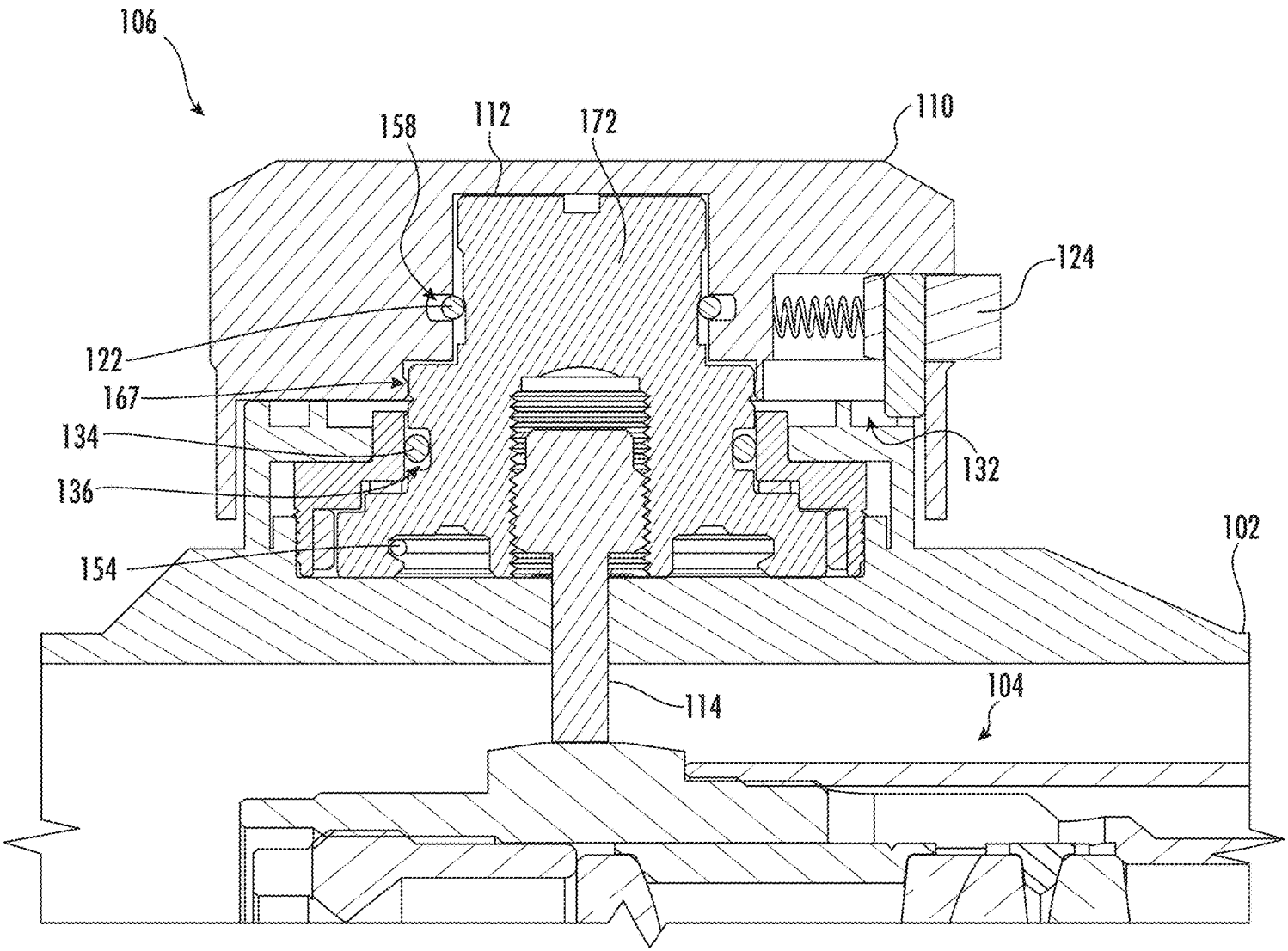
FIG. 5 is an enlarged cross-sectional view of the riflescope and adjustment knob of FIG. 1 showing the dial engaged with the rotating member.

With reference to FIGS. 1-3, in the embodiment shown, adjustment knob 106 includes a dial 110 configured to engage and disengage with a rotating member 112 (which is also rotatable about axis 108). When in an engaged position (as illustrated in FIG. 5), dial 110 is engaged with rotating member 112. When in a disengaged position (as illustrated in FIG. 3), dial 110 is disengaged with rotating member 112. In some embodiments, rotating member 112 may be configured as a rotating adjustment nut or spindle that includes a hub 172. When there is engagement between dial 110 and rotating member 112, a setting of riflescope 100 can be changed. In the example illustrated, an adjustment screw (or threaded plunger) 114 is coupled (e.g., threaded) to an interior threaded cavity of the rotating member 112 and rotationally constrained in a slot in housing 102 so that rotation of dial 110 and rotating member 112 causes responsive movement of adjustment screw 114 along axis 108, and driving pivoting movement of erector system 104, illustrated by arrows 116, which effects a point of aim shift either vertically (elevation) or horizontally (windage) depending on the position of the adjustment knob 106 on the housing 102. In other embodiments (not illustrated), the rotating member 112 may be an externally threaded screw that is threaded into a threaded hole fixed on housing 102, so that the screw moves axially as it rotates to effect changes in the point of aim or other setting of riflescope 100. The shift in the point of aim of riflescope 100 is typically accomplished through cooperation between lenses or other optical elements within erector system 104 and a reticle 118 within housing 102. A spring 120 biases erector system 104 relative to housing 102 to press erector system 104 against screw 114. In FIG. 1, adjustment knob 106 is shown disengaged with rotating member 112. While FIG. 1 shows a single adjustment knob 106, it should be understood that a second adjustment knob (not visible) may be coupled to housing 102 orthogonally relative to adjustment knob 106, where adjustment knob 106 is one of an elevation adjustment knob which effects a point of aim shift vertically or a windage adjustment knob which effects a point of aim shift horizontally and the second adjustment knob is the other of the elevation adjustment knob or windage adjustment knob.

As shown in FIG. 2, adjustment knob 106 includes a retainer device 122. In some embodiments, retainer device 122 is seated in a different groove (explained with respect to FIGS. 3-5) of rotating member 112 depending on when adjustment knob 106 is in the engaged or disengaged position. In some embodiments, retainer device 122 is a spring, such as a spring snap ring, for example, and the ring may encircle rotating member 112 fully or partially. In other embodiments, the retainer device may be omitted, or retention may be accomplished through different structures for features.

In some embodiments, adjustment knob 106 further includes a locking mechanism 123 which may include a lock release 125 and a guideway ring 130. In the embodiment illustrated, lock release 125 comprises a depressible button 124 located on a side of dial 110 and accessible from outside of dial 110. Button 124 includes one or more springs 126 that bias button 124 radially outward and a pin 128, guide tab, or other protrusion, movable with button 124 radially relative to axis 108 when button 124 is pressed and released. The button 124 is movable relative to dial 110 and rotating member 112 to release locking mechanism 123 and allow dial 110 and rotating member 112 to be co-rotated to adjust a setting of riflescope 100. Guideway ring 130 is affixed to housing 102 of riflescope 100, for example by press-fitting guideway ring 130 onto a threaded flange 140 that has been threadably secured to housing 102. In this manner, a channel 132 or other guideway of guideway ring 130 is fixed relative to housing 102. In the embodiment shown, when adjustment knob 106 is in the disengaged position as illustrated in FIG. 3, pin 128 is retracted axially from channel 132 of guideway ring 130, but when adjustment knob 106 is in the engaged position as illustrated in FIG. 5, pin 128 (or guide tab or other protrusion) is received in channel 132 and travels within channel 132 or otherwise rides along the channel 132 or other guideway as dial 110 is rotated. Pin 128 (or guide tab or other protrusion) is biased into a notch 133 (FIG. 2) formed in the guideway of the guideway ring 130 at a zero location of the dial 110 to lock adjustment knob 106 at the zero location, as is described in greater detail in patent No. U.S. Pat. No. 9,170,068, which is incorporated herein by reference. When the button 124 or other lock release 125 is depressed or otherwise actuated, it moves the pin 128 (or other guide tab or protrusion) out of notch 133 to release the locking mechanism 123 and allow the dial 110 to be rotated away from the zero location. In some embodiments, locking mechanism 123 does not lock at any rotational position of dial 110 other than the zero location. In other embodiments locking mechanism 123 may lock at multiple rotational positions of dial 110. In yet other embodiments, locking mechanism 123 may comprise any of various different adjustment knob locking mechanisms, particularly those locking mechanisms including a lock release accessible from outside the dial 110, and/or those including a lock release carried by the dial 110 for rotation therewith about the axis 108, such as lock release button located on a side of the dial 110 that is depressible in a radial direction toward the axis 108 to release the locking mechanism. Locking mechanisms that are lockable electronically or by other means are also envisioned.

In the embodiment shown, an O-ring 134 is seated within a groove 136 of rotating member 112 (shown in FIG. 3), and a washer 138 is seated within a groove 142 of threaded flange 140 (shown in FIG. 2).

In some embodiments, adjustment knob 106 includes a click mechanism to provide tactile and/or audible feedback to the user when adjustment knob 106 is rotated. For example, in the embodiment shown, a click ring 144 is interposed between a shoulder 150 of the lower base portion 148 of rotating member 112 and threaded flange 140. Click ring 144 includes a grooved surface 146 facing rotating member 112. Grooved surface 146 includes regularly spaced apart features, which, for example, include splines or a series of evenly spaced vertical grooves or ridges. Other engagement features may include a series of detents, indentations, apertures, or other suitable features. The click mechanism further includes a click pin 152 with a ramped surface configured to engage the regularly spaced apart features of grooved surface 146. Click pin 152 is housed within a bore 156 in rotating member 112 that has an open end facing grooved surface 146. A spring 154 or other biasing element urges click pin 152 to extend outwardly from within bore 156 and engage grooved surface 146. In operation, rotational movement of adjustment knob 106 about axis 108 causes click pin 152 to move out of contact with one groove and into a neighboring groove, thereby producing a click that is either audible, tactile, or both. Each click may coincide with an adjustment amount to alert the user about the extent of an adjustment being made.

FIG. 3 is an enlarged isometric cross-sectional view of adjustment knob 106 of FIG. 1, showing dial 110 disengaged with rotating member 112 (meaning that rotation of dial 110 will not cause rotation of rotating member 112 or any change to the setting of riflescope 100 by movement of internal optical components within housing 102 or otherwise). In the embodiment shown, a retainer device 122 is at least partially housed by and carried by a retainer groove 158 formed in dial 110 such that retainer device 122 is axially moveable relative to rotating member 112 with dial 110, but is not axially movable relative to dial 110. In some embodiments, retainer groove 158 is sized such that it allows free expansion of retainer device 122 within it.

Figure 4:
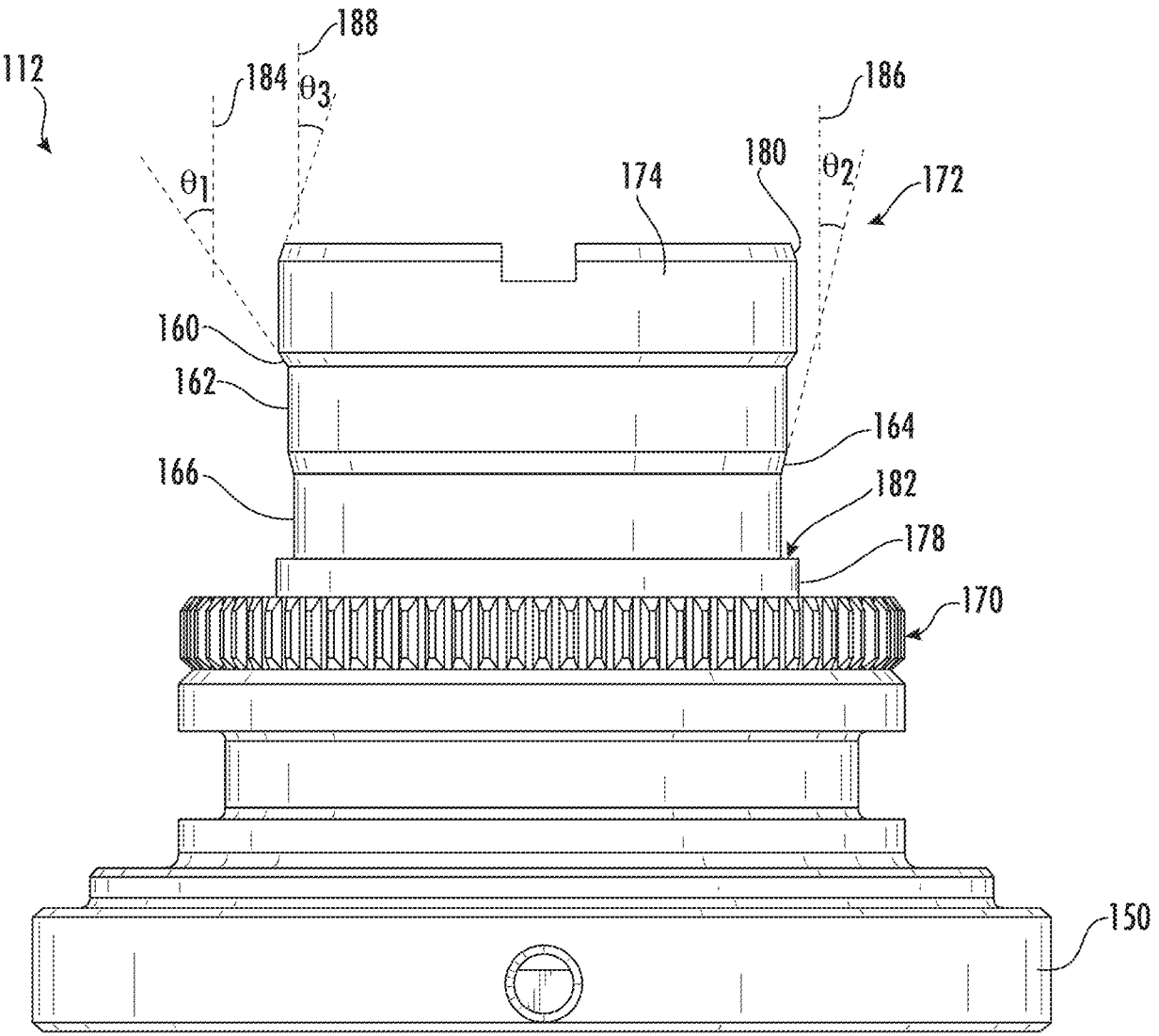
FIG. 4 is an enlarged, isolated side view of the rotating member of FIG. 3 showing details of dial retention features of the rotating member.

With reference to FIG. 3 and FIG. 4, in the embodiment shown, rotating member 112 includes a disengagement ridge 160, a disengagement groove 162, a ridge 164, and an engagement groove 166, where disengagement groove 162 and engagement groove 166 are spaced apart and ridge 164 is formed between grooves 162 and 166. In some embodiments, ridges 160 and 164 and grooves 162 and 166 are formed in hub 172 of rotating member 112. In some embodiments, disengagement groove 162 and engagement groove 166 are spaced apart on hub 172 and ridge 164 is formed between grooves 162 and 166 on hub 172. Items 160-166 are discussed further below. In other embodiments, grooves 162, 166 and ridges 160, 164 may be formed on a shaft, shank, or shoulder of an adjustment screw.

Adjustment knob 106 may include a clutch 167 that selectively couples dial 110 to rotating member 112 for co-rotation. In the embodiment shown, clutch 167 includes a dial clutch surface 168 on dial 110 and a rotating member clutch surface 170 on rotating member 112. Dial 110 is illustrated in FIG. 3 in a disengaged position with dial clutch surface 168 moved axially outward and disengaged from rotating member clutch surface 170. In the disengaged position, the clutch 167 is said to be disengaged or released, whereas in the engaged position the clutch 167 is engaged. In some embodiments, one of dial clutch surface 168 and rotating member clutch surface 170 may have at least one male spline, and the other of dial clutch surface 168 and rotating member clutch surface 170 may have at least one female spline. Either of dial clutch surface 168 and rotating member clutch surface 170 may have male or female splines formed thereon at the same or different pitches. In some embodiments, dial clutch surface 168 may include a spline ring in the form of a plurality of splines that fully or partially encircle an interior cavity 218 of dial 110, and rotating member clutch surface 170 may include a spline ring in the form of a plurality of splines that fully or partially encircle an outer surface of rotating member 112. In some embodiments, dial clutch surface 168 and rotating member clutch surface 170 have the same number of splines, while in other embodiments, dial clutch surface 168 and/or rotating member clutch surface 170 have a different number of splines or no splines at all. It should be noted that dial clutch surface 168 and rotating member clutch surface 170 need not have the same arrangement of splines. For example, one of dial clutch surface 168 and rotating member clutch surface 170 may include one or more splines arranged such that the splines fully encircle interior cavity 218 or an outer surface of rotating member 112, while the other of dial clutch surface 168 and rotating member clutch surface 170 may include only a single spline or a plurality of splines that only partially encircle interior cavity 218 or an outer surface of rotating member 112. It should be noted that dial clutch surface 168 and rotating member clutch surface 170 need not use the same type of engaging components. For example, one of dial clutch surface 168 and rotating member clutch surface 170 may include one or more splines, while the other of dial clutch surface 168 and rotating member clutch surface 170 may include one or more keys or one or more ridges. In another example (not illustrated), dial clutch surface 168 and rotating member clutch surface 170 may each have at least one tooth and form a Hirth joint when dial clutch surface 168 and rotating member clutch surface 170 are engaged. Alternative push-button style clutches are described below with reference to FIGS. 7-13. Many other designs for clutches are also envisioned, including conical clutches, plate clutches, rotary-actuated clutches, electronically actuated clutches, etc.

In some embodiments (not illustrated), the splines of dial clutch surface 168 or rotating member clutch surface 170 may be axially elongated so they can be used both as an element of clutch 167 and as a detent ring for the click mechanism of adjustment knob 106, eliminating the need for a separate detent ring 144.

With reference to FIG. 3, dial 110 is illustrated in a disengaged position, where retainer device 122 is seated in disengagement groove 162, abutting disengagement ridge 160, and substantially housed by retainer groove 158. It should be noted that dial 110 may also be in a disengagement position when retainer device 122 is seated in disengagement groove 162 but not abutting disengagement ridge 160.

With reference to FIGS. 3-5, in the embodiment shown, dial 110 is moveable to an engaged position by pushing dial 110 toward housing 102 (FIGS. 1 and 5) such that retainer device 122 moves over ridge 164 to engagement groove 166 and dial 110 is in an engaged position having dial clutch surface 168 and rotating member clutch surface 170 engaged with each other. FIG. 5 is an enlarged cross-sectional view of adjustment knob 106 showing dial 110 in the engaged position. In the engaged position, rotation of dial 110 will rotate rotating member 112 and change a setting of riflescope 100, e.g., by moving erector system 104 within housing 102.

In some embodiments, when retainer device 122 is seated in the disengagement groove 162, retainer device 122 is substantially housed by retainer groove 158. For example, substantially housed means that about 50% or more of a diameter of retainer device 122 is received in retainer groove 158. In some embodiments, when retainer device 122 is seated in the engagement groove 166, retainer device 122 is only partially housed by retainer groove 158. For example, partially housed means that less than about 50% of a diameter of retainer device 122 is housed by retainer groove 158. It should be noted that in some embodiments, retainer device 122 may be partially housed or substantially housed by retainer groove 158 when it is seated in one or both of disengagement groove 162 or engagement groove 166.

In some embodiments, when dial 110 is moved from a disengaged position to an engaged position (and vice versa), retainer device 122 is moved between disengagement groove 162 and engagement groove 166 and rides over a ridge 164 when moving between grooves 162 and 166. In some embodiments, when retainer device 122 moves or rides over ridge 164 when traveling from engagement groove 166 to disengagement groove 162, retainer device 122 expands into retainer groove 158 such that a greater portion of retainer device 122 is housed by retainer groove 158 when retainer device 122 is seated in the disengagement groove 162 relative to when retainer device 122 is seated in the engagement groove 166. In some embodiments, when retainer device 122 moves or rides over ridge 164 when traveling from disengagement groove 162 to engagement groove 166, retainer device 122 collapses out of retainer groove 158 such that a smaller portion of retainer device 122 is housed by retainer groove 158 when retainer device 122 is seated in the engagement groove 166 relative to when retainer device 122 is seated in the disengagement groove 162.

Retainer device 122 can be configured such that it limits or reduces total travel from the engaged position to the disengaged position (and vice-versa). For example, retainer device 122 can apply constant or substantially constant friction to rotating member 112 such that free movement of retainer device 122 is limited or reduced. In some embodiments, the snap ring or other spring of retainer device 122 may be sized and selected to cooperate with ridge 164 for requiring a minimum pull force to move dial 110 from the engaged position to the disengaged position. The minimum pull force can be a value in the range from about 1 lb. to about 10 lbs, or between about 2 lbs. and 10 lbs. Disengagement ridge 160 is preferably sized larger than engagement ridge 164 to require a pull force preferably exceeding 10 lbs., or exceeding 14 lbs., to remove dial 110 from rotating member 112. In some embodiments, the push force required for moving dial 110 from the disengaged position to the engaged position is about 2 lbs. or less or less than about 1 lb.

It should be noted that while FIGS. 1-5 illustrate embodiments where disengagement groove 162 and engagement groove 166 are formed on rotating member 112 and retainer groove 158 is formed on dial 110, embodiments having other configurations are encompassed by this disclosure. For example, in some embodiments, dial 110 may have a plug configured to insert into a receiving cavity formed in hub 172 of rotating member 112, and the plug may have a disengagement groove and an engagement groove formed thereon substantially similar to grooves 162 and 166. In some embodiments, the receiving cavity of hub 172 may have a retainer groove formed therein substantially similar to retainer groove 158. In such embodiments, retainer device 122 may partially or fully encircle the plug. In such embodiments, retainer device 122 is at least partially housed by and carried by the retainer groove of the receiving cavity such that retainer device 122 is axially moveable relative to dial 110 but not axially movable relative to rotating member 112. In still other embodiments, disengagement groove, engagement groove, and retainer device may be omitted, as illustrated in FIGS. 7-13. Retainer device may also be integrally formed with one or both of dial 110 and rotating member 112, or in other components of adjustment knob 106. In other embodiments, retention may be provided by suction or vacuum through the use of an airtight seal between dial 110 and rotating member 112. Such an airtight seal may be accomplished through the use of a precise mechanical fit, or by O-rings or other seals, while a desired range of movement may be provided through the use of a bladder or flexible diaphragm contained within the adjustment knob and in communication with the sealed space between the dial 110 and rotating member 112. To achieve suction or vacuum, the assembly of such a device may involve bleeding off air from the enclosed space through a vent in the side of the dial 110 as the dial 110 is fitted onto rotating member 112, then sealing the vent after the assembly of dial 110 is complete.

FIG. 4 is an enlarged, isolated view of rotating member 112 of adjustment knob 106. As illustrated in FIG. 4 and discussed above, in some embodiments, rotating member 112 includes disengagement ridge 160, disengagement groove 162, ridge 164, and engagement groove 166 formed in a hub 172 of rotating member 112. In some embodiments, hub 172 also includes a top rib 174 and a bottom rib 178. Engagement groove 166 can also be referred to as a first circumferential step, disengagement groove 162 can also be referred to as a second circumferential step, top rib 174 can also be referred to as a third circumferential step, and bottom rib 178 can also be referred to as a fourth circumferential step. For example, the first circumferential step may be formed by a first circumference of rotating member 112 and the second circumferential step may be formed by a second circumference of rotating member 112, wherein the first circumference is less than the second circumference. For example, the third circumferential step may be formed by a third circumference of rotating member 112 and the fourth circumferential step may be formed by a fourth circumference of rotating member 112, wherein the third circumference is greater than the second circumference, and the third circumference is less than the fourth circumference. For example, the third circumference and fourth circumference may be equal. Moreover, in some embodiments, disengagement groove 162 is formed by a first diameter of rotating member 112 and the engagement groove 166 is formed by a second diameter of rotating member 112, where the first diameter is larger than the second diameter such that the engagement groove 166 is deeper than the disengagement groove 162 relative to an outer circumferential surface of hub 172.

Disengagement ridge 160 and ridge 164 can also each be referred to as a chamfer, for example. For example, a top ridge 180 may be formed on top rib 174, and may also be referred to as a chamfer. In some embodiments, one or more of ridges 160, 164, and 180 are sloped or inclined.

In the embodiment shown in FIG. 4, ridge 160 forms a retention θ1 with a vertical axis 184 around rotating member 112 which is parallel to axis 108 (FIG. 1). Retention angle θ1 is sized and chosen to cooperate with retainer device 122 to inhibit dial 110 from being detached from rotating member 112. In some embodiments, angle θ1 is about 45 degrees. In some embodiments, angle θ1 can range from about 30 degrees to about 60 degrees. In the embodiment shown, ridge 164 forms a retention angle θ2 with a vertical axis 186 around rotating member 112 which is parallel to axis 108 (FIG. 1). In some embodiments, angle θ2 is about 17 degrees. In some embodiments, angle θ2 can range from about 10 degrees to about 30 degrees. In some embodiments, top ridge 180 also forms an angle θ3 with a vertical axis 188 around rotating member 112. In some embodiments, angle θ3 is about 30 degrees. In some embodiments, angle θ3 can range from about 10 degrees to about 45 degrees. In some embodiments, angle θ3 is selected such that installation of retainer device 122 on rotating member 112 will limit or avoid or reduce damage on hub 172 and/or retainer device 122 from incidence with a surface of rotating member 112, such as a surface of top rib 174 (which may have the largest diameter of hub 172 that retainer device 122 rides over).

In some embodiments, a distance between ridge 160 and ridge 164, forming a length of disengagement groove 162, is about 0.09 inches. In some embodiments, a distance between ridge 164 and a lip 182 of bottom rib 178, forming a length of engagement groove 166 is about 0.08 inches. In some embodiments, a distance between ridge 160 and top ridge 180, forming a length of top rib 174, is about 0.09 inches. In some embodiments, the length of disengagement groove 162 and engagement groove 166 is selected such that there is enough clearance for pin 128 of button 124 (shown in FIG. 3) to extend into and retract out of a channel 132. In some embodiments, the ratio of lengths between all or a subset of disengagement groove 162, engagement groove 166, and top rib 174 is selected to reduce or limit the overall assembled height of adjustment knob 106 and/or reduce or limit the freedom of movement of adjustment knob 106 to improve ergonomics of engagement and/or disengagement.

Figure 6A:
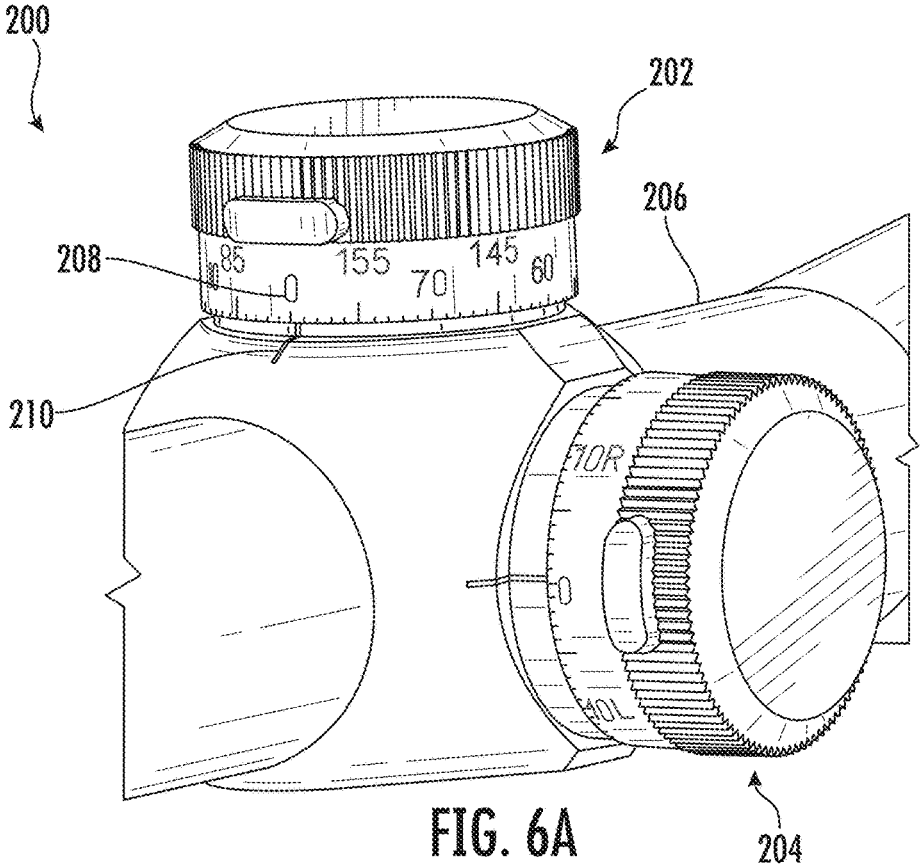
FIGS. 6A and 6B show exterior isometric views of a riflescope having the adjustment knob of FIG. 1 used as an elevation adjustment knob and a windage adjustment knob, where
Figure 6B:
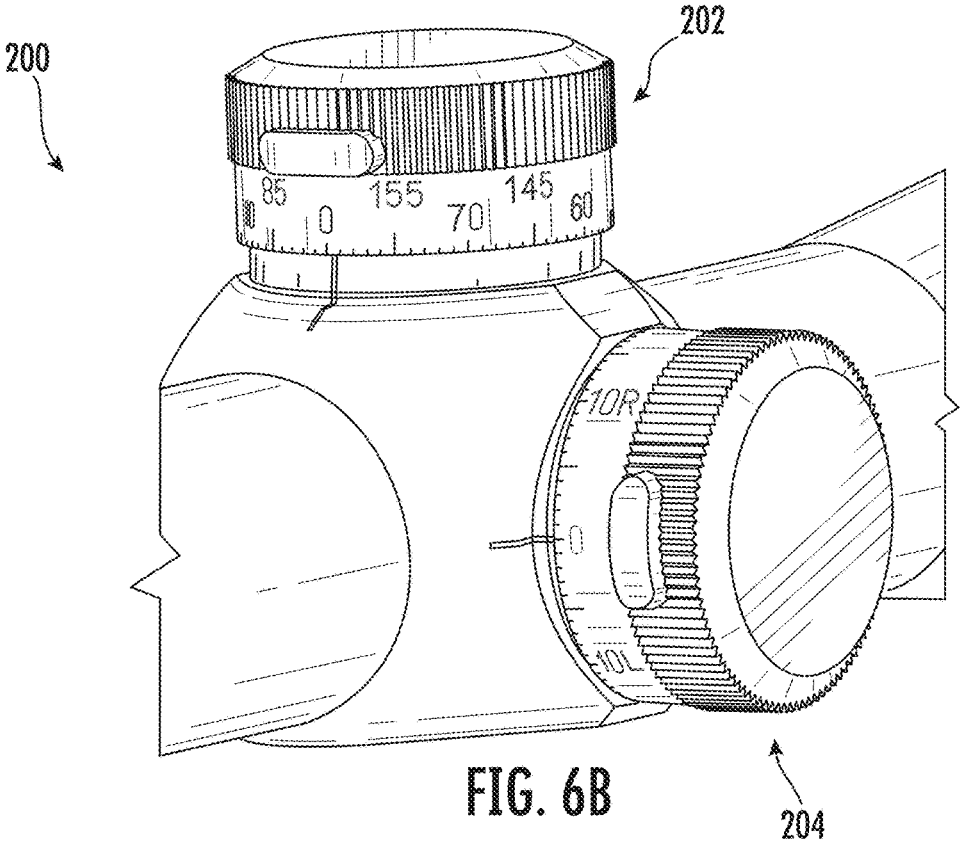

FIG. 6A illustrates a riflescope 200 having adjustment knob 106 used as an elevation knob 202 and a windage knob 204. As shown in FIG. 6A, elevation knob 202 is in an engaged position such that its dial is engaged with a rotating member (112 in FIGS. 1-5) of the elevation knob 202, and windage knob 204 is in a disengaged position such that its dial is disengaged with a rotating member (112 in FIGS. 1-5) of the windage knob 204. A user may have pushed elevation knob 202 toward housing 206 to place elevation knob 202 in its engaged position. In the engaged position, the user may rotate the elevation knob 202 such that optical components of riflescope 200 are adjusted to reflect a particular elevation. The user may then pull elevation knob 202 away from housing 206 to place elevation knob 202 in the disengaged position (as illustrated in FIG. 6B) and then rotate elevation knob 202 until zero mark 208 is aligned with reference mark 210 that is fixed. The user may thereafter push elevation knob 202 back toward housing 206 to place elevation knob 202 in the engaged position, where elevation knob 202 is now zeroed. In FIG. 6A, rotation of windage knob 204 will not cause adjustment of the optical components because windage knob 204 is in a disengaged position. FIG. 6B illustrates an opposite situation to that shown in FIG. 6A where riflescope 200 has elevation knob 202 in a disengaged position and windage knob 204 in an engaged position. When windage knob 204 is in the engaged position illustrated in FIG. 6B, it may be used to adjust optical components of riflescope 200 as discussed above with respect to elevation knob 202 in FIG. 6A.

Figure 11:
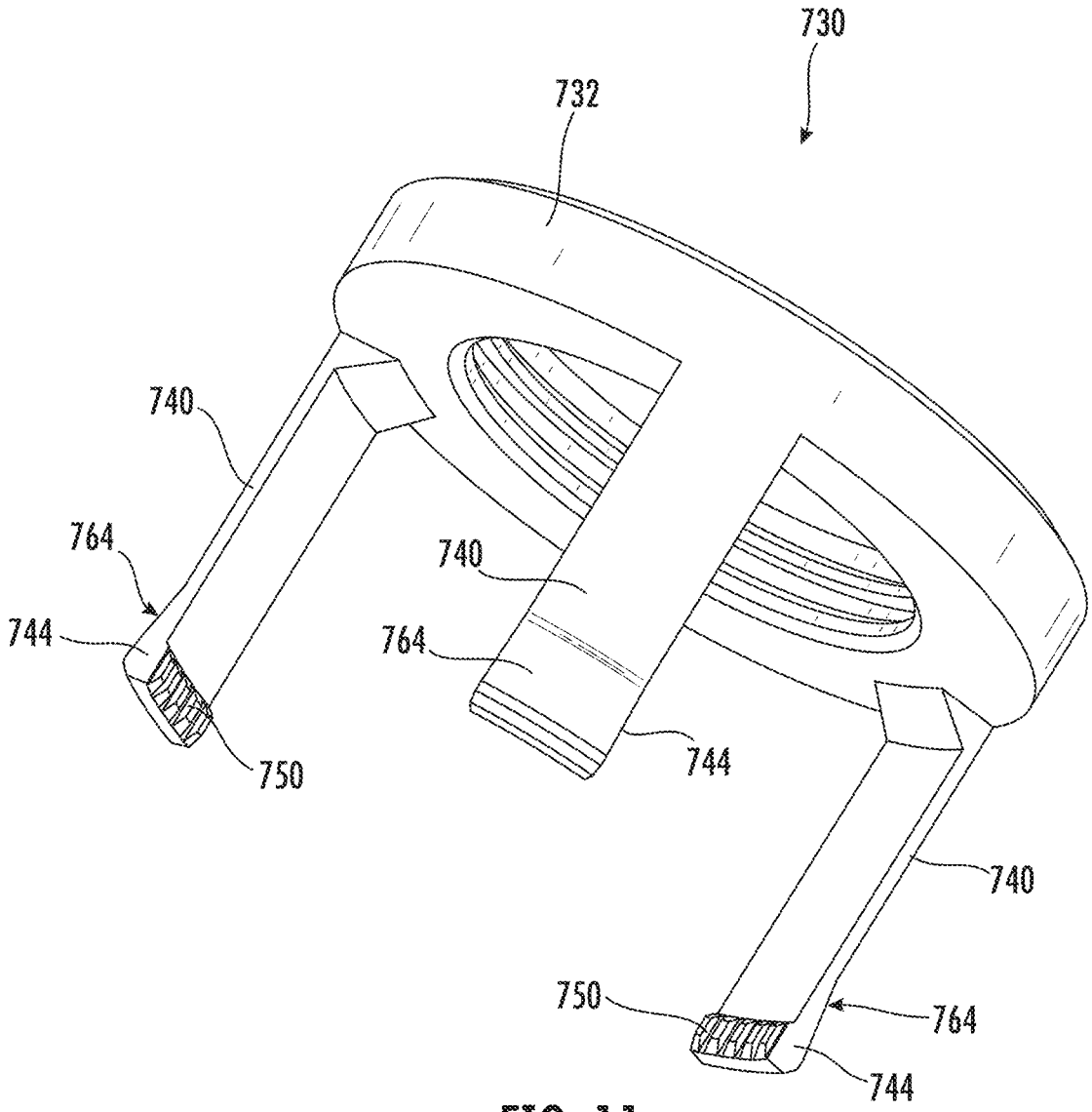
FIG. 11 is a pictorial view of a gripper element of the clutch of the adjustment knob of FIG. 7.
Figure 12:
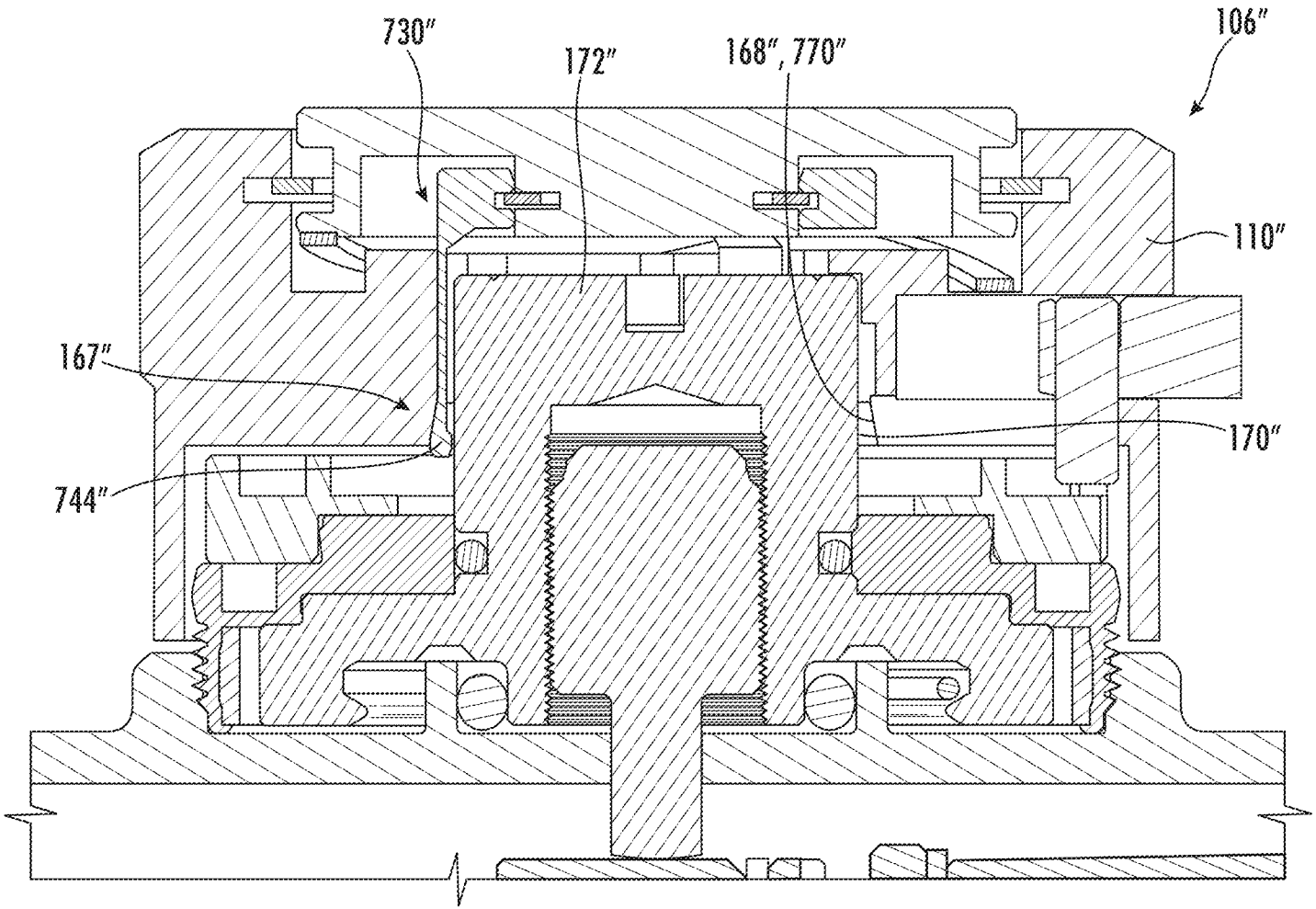
FIG. 12 is a cross-section view showing an adjustment knob according to a third embodiment.
Figure 13:
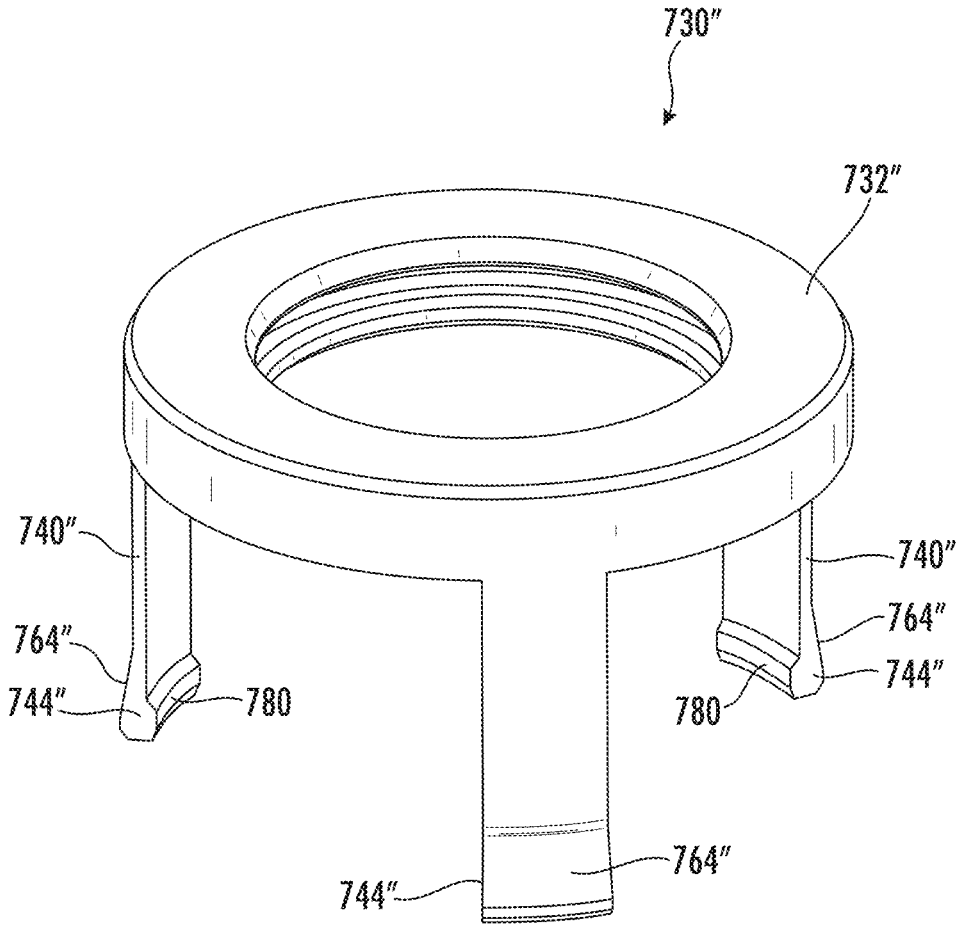
FIG. 13 is a pictorial view of a gripper element of a clutch of the adjustment knob of FIG. 12.

FIGS. 7-11 illustrate an adjustment knob 106' according to another embodiment, and FIGS. 12-13 illustrate an adjustment knob 106" according to yet another embodiment. In FIGS. 7-13, parts of adjustment knobs 106' and 106" that are identical, very similar, and/or functionally equivalent to parts having the same name in the embodiments of FIGS. 1-6 are identified by the same reference numeral followed by a prime symbol (') in the case of the embodiment of FIGS. 7-11, or a double prime symbol (") in the case of the embodiment of FIGS. 12-13, and may not be otherwise described or discussed herein. For example, a guideway ring 130' of a locking mechanism 123' of adjustment knob 106' is identical to guideway ring 130 illustrated in FIGS. 2, 3 and 5, operates in the same manner, and is not otherwise discussed herein.

Figure 7:
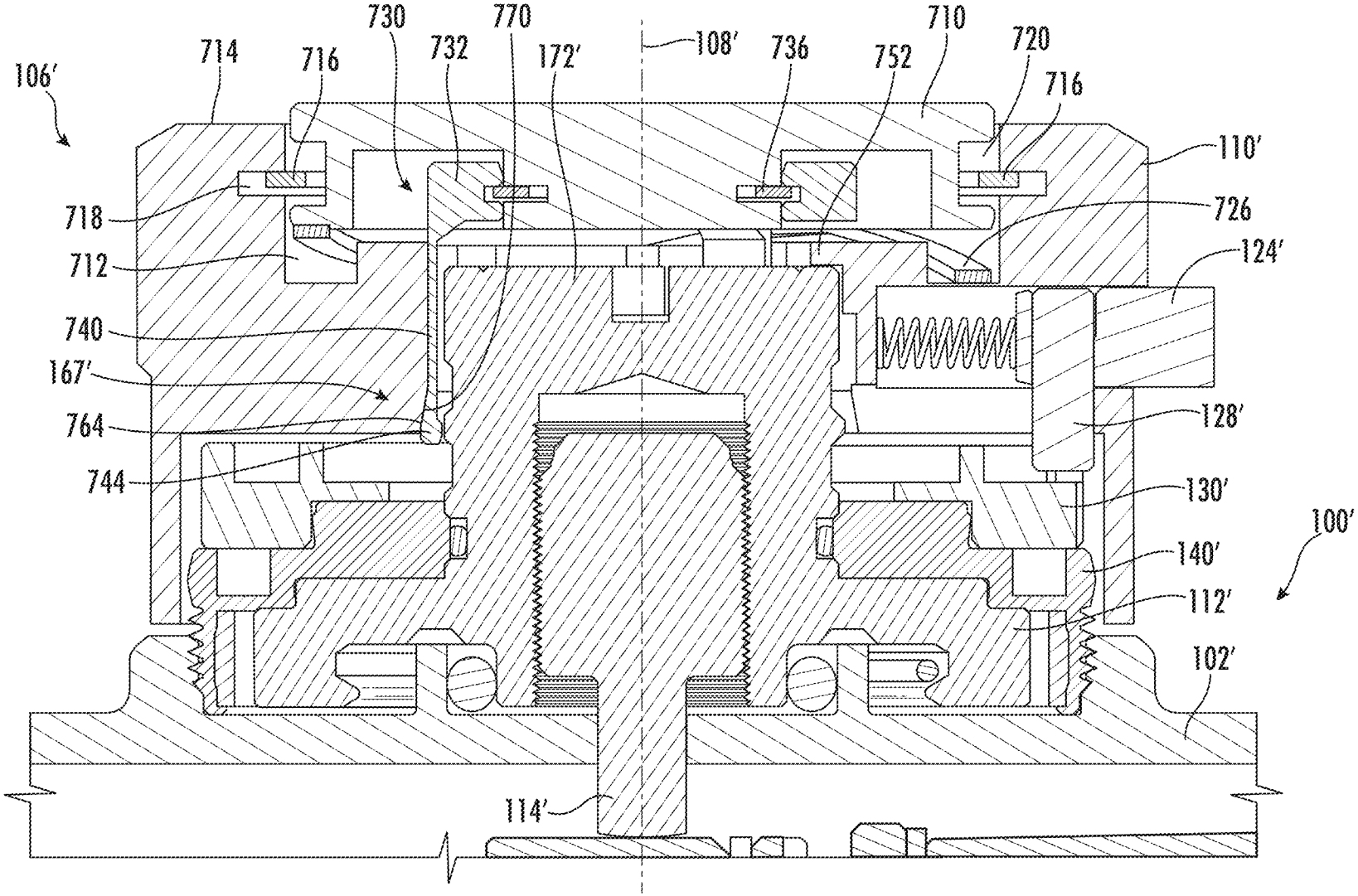
FIG. 7 is a cross-section view showing an adjustment knob according to a second embodiment, showing a clutch of the adjustment knob in an engaged position.
Figure 8:
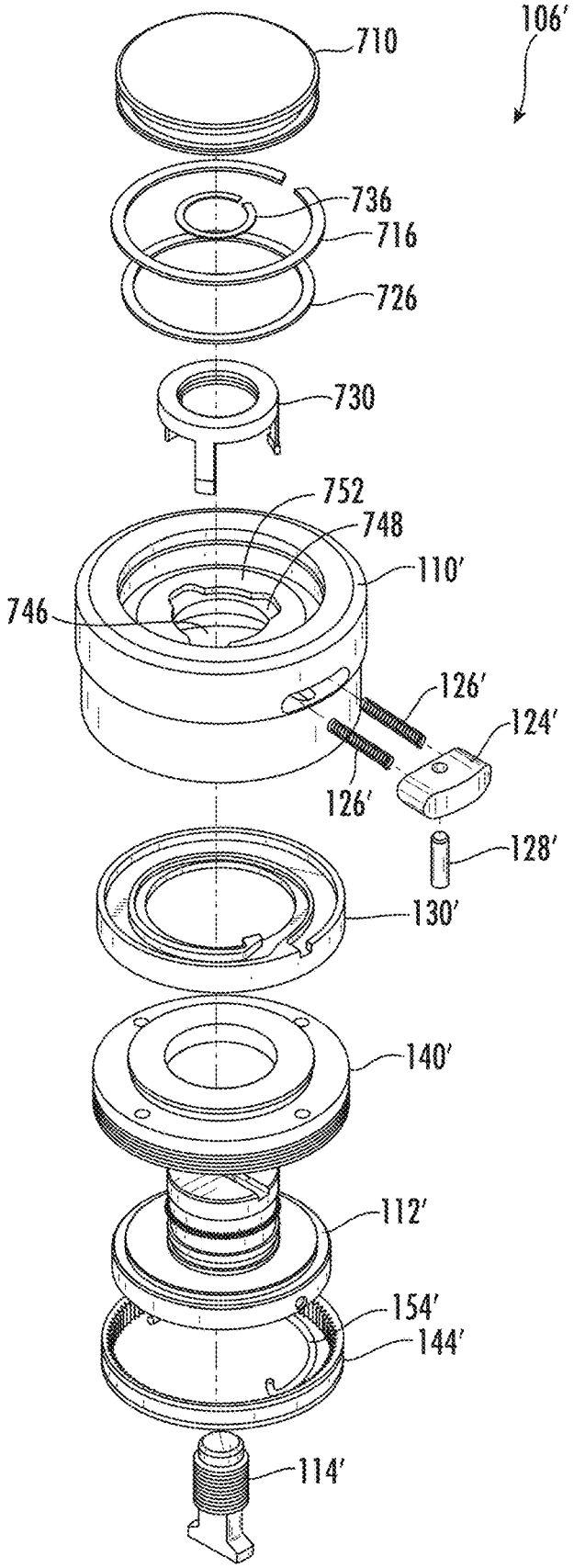
FIG. 8 is an exploded view of the adjustment knob of FIG. 7.
Figure 9:
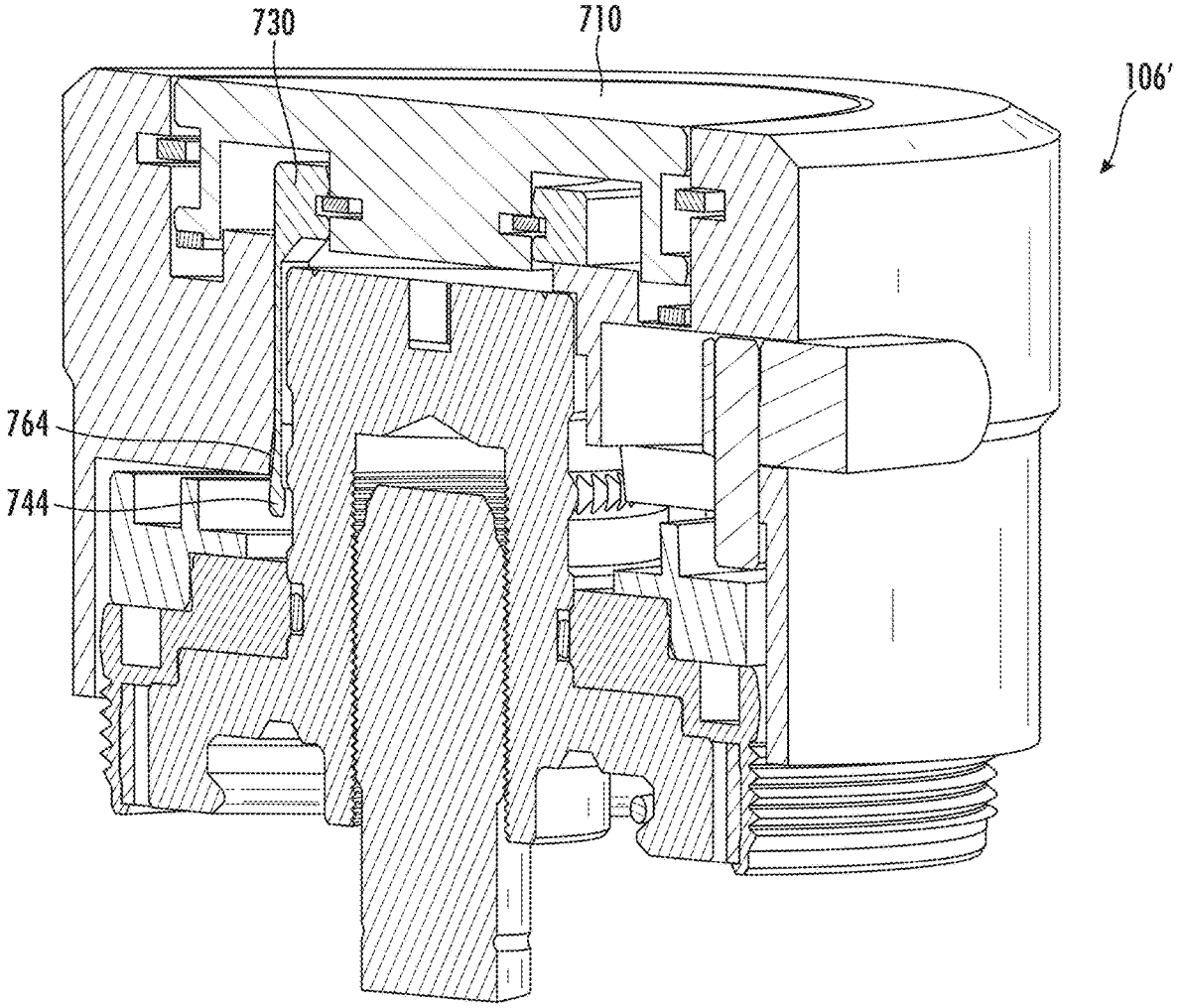
FIG. 9 is an oblique section view of the adjustment knob of FIG. 7, showing a clutch of the adjustment knob in a disengaged position.
Figure 10:
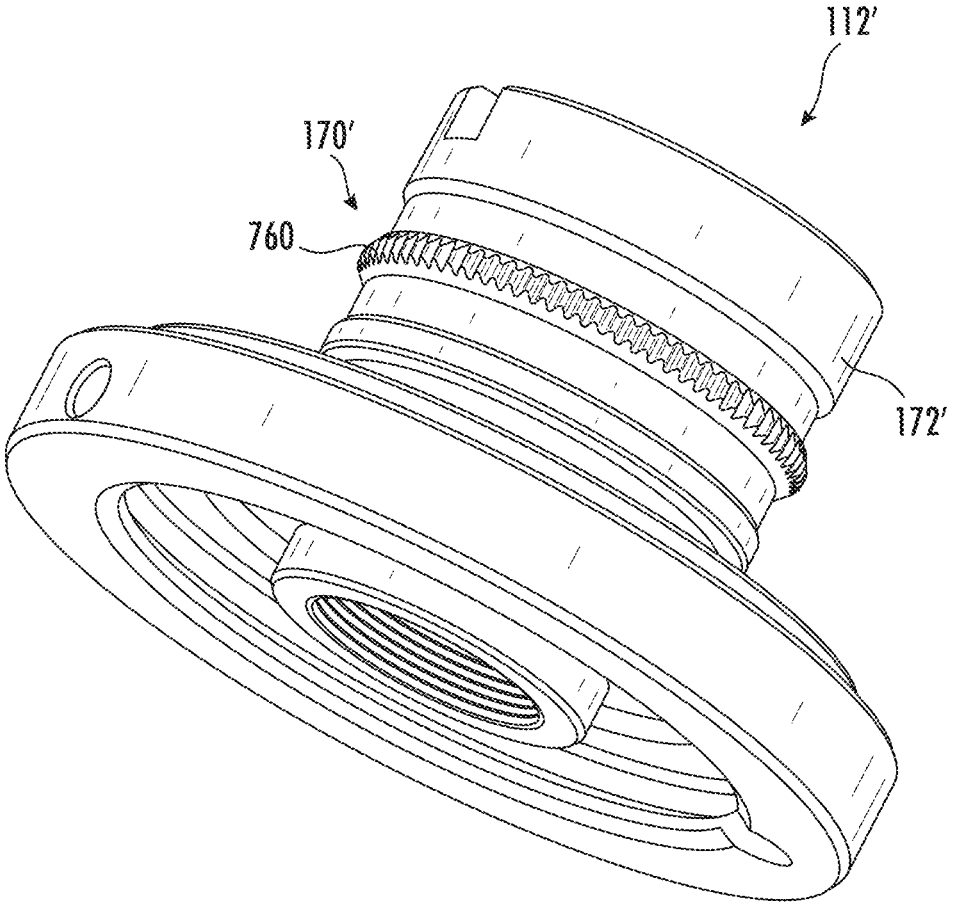
FIG. 10 is a pictorial view of a rotating member of the adjustment knob of FIG. 7.

FIG. 7 is a cross-sectional view of adjustment knob 106' mounted on a riflescope 100' with a clutch 167' (described below) of adjustment knob 106' shown in an engaged position. FIG. 8 is an exploded view of adjustment knob 106'. And FIG. 9 is an oblique section view of adjustment knob 106' with its clutch 167' illustrated in a disengaged position. With reference to FIGS. 7-9, clutch 167' is a push-button style clutch that is actuated by depressing a clutch release button 710 along the axis of rotation 108'. Clutch release button 710 is carried by dial 110' in a counterbore 712 formed in an axial outward end 714 of dial 110' and is accessible from outside of dial 110' at the axial outward end 714. Clutch release button 710 is retained on dial 110' by a retainer ring 716 that is fitted into a groove 718 circumscribing counterbore 712 near axial outward end 714. Retainer ring 716 is received in a circumferential channel 720 in clutch release button 710 that is sized to allow a range of axial movement of clutch release button 710 along axis of rotation 108'. In an alternative embodiment (not illustrated), the retainer ring 716 may be carried in a narrower slot on clutch release button 710 and the groove 718 may be wider to allow retainer ring 716 to move axially therein. Other structures and devices for retaining button 710 on dial 110' may also be utilized. A wave spring 726 is positioned in counterbore 712 between dial 110' and clutch release button 710 to bias clutch release button 710 axially outwardly away from housing 102' of riflescope 100' so as to urge clutch 167' toward the engaged position. Clutch release button 710 is illustrated as being relatively large and extending beyond dial 110' when clutch 167' is in the engaged position, but to prevent accidental release of clutch 167' the clutch release button 710 may alternatively be made smaller and/or sit flush or recessed relative to outward end 714 of dial 110' when clutch 167' is in the engaged position.

A gripper 730 of clutch 167' is attached to clutch release button 710 and extends axially away from an underside of clutch release button 710 toward housing 102'. Gripper 730, which is best illustrated in FIG. 11, includes a mounting ring portion 732 that is coupled to clutch release button 710 via a snap ring 736, and one or more resilient arms 740 extending away from mounting ring portion 732 toward housing 102'. A wedge-shaped gripper shoe 744 is provided near a terminal distal end of each resilient arm 740. In the embodiment illustrated, gripper 730 includes a balanced arrangement of three arms 740 each terminating in a wedge-shaped gripper shoe 744. Each of the arms 740 may extend through bore 746 (FIG. 8) of dial 110' and are received in a lobe 748 of an opening formed in a shoulder portion 752 of dial 110' at the outer end of bore 746. The entirety of gripper 730, including mounting ring portion 732, arms 740, and gripper shoes 744, are preferably formed together in a unitary one-piece construction, such as by molding or by machining from a solid block of metal or other material.

With reference to FIG. 11, each of the gripper shoes 744 may include one or more gripper splines 750, or another type of high-friction surface, on an inner face thereof. Gripper splines 750 face toward and engage a spline ring 760 (FIG. 10) or other rotating member clutch surface 170' of rotating member 112' when clutch 167' is in the engaged condition/position. An outer surface 764 of each gripper shoe 744 on an opposite side of gripper shoe 744 from gripper splines 750 is shaped to wedge into a conical surface 770 or chamfer circumscribing an axially-inner opening of bore 746 (FIG. 8) and forming a dial clutch surface thereof. Outer surface 764 may be smooth (as illustrated) to facilitate smooth actuation of clutch 167', or may textured. As illustrated in FIGS. 7-10, spline ring 760 circumscribes hub 172' of rotating member 112' and gripper splines 750 are formed on a radially-inner surface of each of gripper shoes 744 and facing spline ring 760. However, in an alternative embodiment the gripper splines 750 may be formed on the opposite sides of gripper shoes 744 and spline ring 760 (or other high-friction surface) may circumscribe the axially-inner opening of bore 746, which may or may not be conical or chamfered. In such alternative embodiments, the radially-inner surface of each gripper shoe 744 may be smooth or textured, and optionally inclined or wedge-shaped relative to arms 740, so as to wedge into and grip a complementary rotating member clutch surface on hub 172'.

FIG. 9 illustrates adjustment knob 106' with clutch release button 710 depressed to move gripper 730 axially inward to a disengaged position whereat clutch 167' is disengaged so as to allow dial 110' to be rotated relative to rotating member 112' for zeroing the adjustment knob 106' without changing the elevation or other setting of riflescope 100.

FIGS. 12 and 13 illustrate an alternative embodiment of an adjustment knob 106" including a push-button style clutch 167" similar to the push-button clutch 167' of FIGS. 7-11, but in which gripper shoes 744" lack splines on either side. Gripper shoes 744" may be smooth or roughened. The inner gripping surface 780 of gripper shoes 744" may be raised to provide optimal engagement or gripping with rotating member clutch surface 170". Similarly, the embodiment of FIGS. 12 and 13, omits splines from the dial clutch surface 168" and rotating member clutch surface 170". Although rotating member clutch surface 170" is illustrated as merely being a cylindrical side surface of hub 172", the rotating member clutch surface 170" may be roughened to improve grip, or may include a ridge or detent (not illustrated) to improve grip and retention when clutch 167" is engaged.

In accordance with a method of use of an aiming device, an adjustment knob 106 of the aiming device of the kind including a dial and a rotating member rotatable about an axis of rotation 108 to change a setting of the aiming device, is zeroed following initially sighting-in the aiming device. The process of sighting-in an aiming device such as a riflescope, is well known, and typically involves shooting a weapon to which the aiming device is attached and observing deviation of the point of impact of the bullet or other projectile on a target at a known range, such as 100 yards, or 200 yards, or 100 meters (m), or 200 m. The deviation of the point of impact relative to the point of aim of the riflescope or aiming device indicates how much adjustment must be made to the aiming device-in terms of elevation (vertical) adjustment and windage (lateral) adjustment-in order for the scope to be "sighted-in" at that range. The step of "sighted-in" then involves releasing a locking mechanism 123 of the adjustment knob, for example by manually depressing a lock release button 124 located on the dial 110 or by otherwise moving a lock release 125 relative to the dial 110 and the rotating member 112; and, while the locking mechanism 123 is released, rotating the dial 110, whereby the rotating member 112 co-rotates with the dial 110 to adjust an aim of the aiming device, until the aiming device is accurately targeting a point of impact of a firearm or other weapon (not illustrated) to which the aiming device is attached. Once the aiming device has been sighted-in, the method next involves disengaging a clutch 167 of the adjustment knob 106 that selectively couples the dial 110 to the rotating member 112; and, while the clutch 167 is disengaged, rotating a dial 110 of the adjustment knob 106 about the axis of rotation 108, relative to the rotating member 112, until the dial 110 is at its zero position, then engaging the clutch 167 to couple the dial 110 to the rotating member 112 for co-rotation therewith about the axis of rotation 108 for adjusting the aim of the aiming device. In some embodiments the lock release button 124 is located on a side of the dial 110 and releasing the lock mechanism 123 includes manually depressing the button 124 in a radial direction toward the axis of rotation 108. In some embodiments, disengaging the clutch 167 may involve moving at least a portion of the dial 110 axially relative to the rotating member 112.

If sighting-in requires a downward adjustment of the aiming device from its locked position, the method may further include prior to completing the sighting-in process, releasing the locking mechanism 123 and adjusting the adjustment mechanism 106 in a positive direction to clear a zero locked position of the locking mechanism 123, then disengaging the clutch and rotating the dial 110 in the same direction (positive direction) relative to the rotating member 112 while the clutch 167 is disengaged, and then re-engaging the clutch 167 after rotating the dial 110 relative to the rotating member 112. Thereafter a shot is taken with the weapon and the sight adjusted until it is sighted-in, and the remainder of the method described above is then completed to zero the dial.

Engagement Lock For Tool-Less Re-Zero Adjustment Knob

Turret assemblies in which a knob (or other first rotatable device) may be, selectively, 1) co-rotated with a spindle (or other second rotatable device) or 2) rotated relative to the spindle (or other second rotatable device) are known. These turret assemblies allow an operator to re-zero the turret assembly (e.g., by rotating the first rotatable device without producing rotation of the second rotatable device).

In some of these known turret assemblies, an operator may be required to use a tool, in order to disengage the rotatable devices (so that the first rotatable device may be rotated relative to the second rotatable device). Tool-less arrangements are also known, but some of the known tool-less arrangements may require a user to separate one or more parts from the turret assembly (say, taking off a removable cap to access a user interface that is not otherwise accessible). This creates the possibility of losing the separated parts in the field.

One example of a tool-less arrangement, which also may not require separating parts (and accepting risk of losing the separated part in the field), is described with respect to FIGS. 7-10 of the present application. In FIG. 9, the clutch release button 710 is depressed, which allows the dial 110' to be rotated relative to the hub 172' (because the gripper shoes 744 are unaligned with the outer surface 764). In contrast, in FIG. 7 the clutch release button 710 is not depressed, which allows the dial 110' and the hub 172' to be co-rotated (because the gripper shoes 744 are aligned with the outer surface 764). Put another way, gripper 730 may be moved up or down relative to both the dial' and the hub 172' by moving the clutch release button 710 up or down.

The embodiment described above has the advantage that an operator can, in a single actuation, unalign the gripper shoes 744 and the outer surface 764, which allows the operator to then rotate the dial 110' relative to the hub 172' (and of course, the single actuation can be performed without tools and/or without separating parts).

Although the operability described with reference to FIGS. 7-9 of the present application (in which an operator need only perform a single actuation to tool-lessly enable the first rotational device to be rotated relative to the second rotatable device), may be very desirable for some applications, such as shooting in a controlled environment such as a range, it may be undesirable for other applications. For instance, during hiking/hunting through thick vegetation, it may be possible to unintentionally tool-lessly actuate the button 710, which may result in a shooter or hunter unintentionally changing their zero setting.

Various embodiments described herein provide a novel operability for unlocking a zero adjustment of a turret assembly, in which more than one tool-less actuation may be used to enable the change (e.g., to enable the first rotational device to be rotated relative to the second rotatable device, in one example). In various embodiments, none of the tool-less actuations require separating parts from the turret assembly, which prevents the possible loss of parts in the field. Thus, the possibility of a tool-less unintentional adjustment of the zero setting in various applications may be reduced, and while still avoiding a requirement to separate parts and the related inherent risks associated therewith.

To further reduce the possibility of an unintentional adjustment of the zero setting, in some embodiments one of the actions may involve moving a component toward the hub and another one of the actions involves moving a component away from the hub. The use of different directions for the actuations (e.g., opposite directions, providing by pushing/pulling in some examples) may further decrease the possibility of an unintentional adjustment of the zero setting in various applications.

In some embodiments, in addition to the different directions of movement (or as an alternative to using different directions in other embodiments), a sequence of operations may be utilized to enable a re-zero readjustment (in which, the more than one operations may need to be performed in a specific order to enable zero adjustment). Referring briefly to FIGS. 17A-E, in an initial operation in a sequence, the operator may actuate the button 1490, e.g., from the raised state shown in FIG. 17B to the depressed state shown in FIG. 17C. This may permit the operator to perform a subsequent operation of the sequence-which can be seen by carefully comparing FIGS. 17C and 17D. With the engagement lock in the unlocked state as shown in FIG. 17C, the operator can then move component(s) in an axial direction away from the second rotational device.

In this embodiment, the component(s) include the first rotational device. For instance, in FIG. 17D the first rotational device (e.g., the knob) has been moved in an axial direction away from the second rotational device (e.g., the hub). This is evident because a gap 1449 can be seen in FIG. 17D (whereas in FIG. 17C the gap is not present).

Figure 17A:
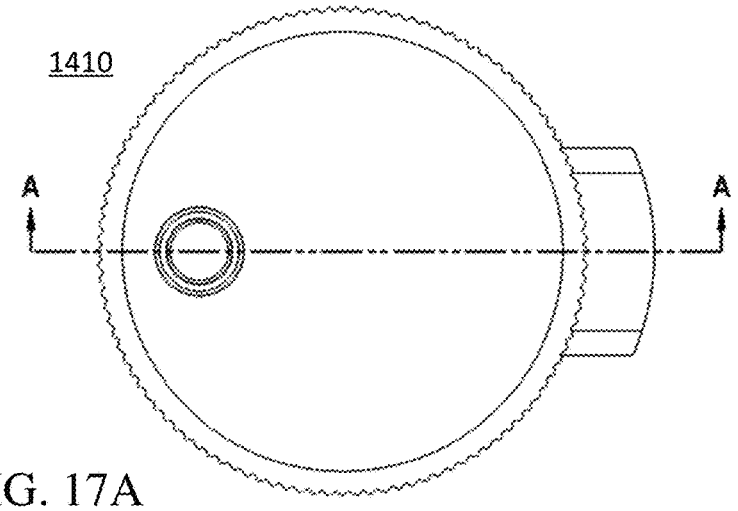
FIGS. 17A and 17B are, respectively, a top view and a cross-sectional view (taken along section line AA), respectively, of the turret assembly of FIG. 14A in the following condition: locked in an engaged mode of operation, engagement lock in the locked state, ready to dial.
Figure 17B:
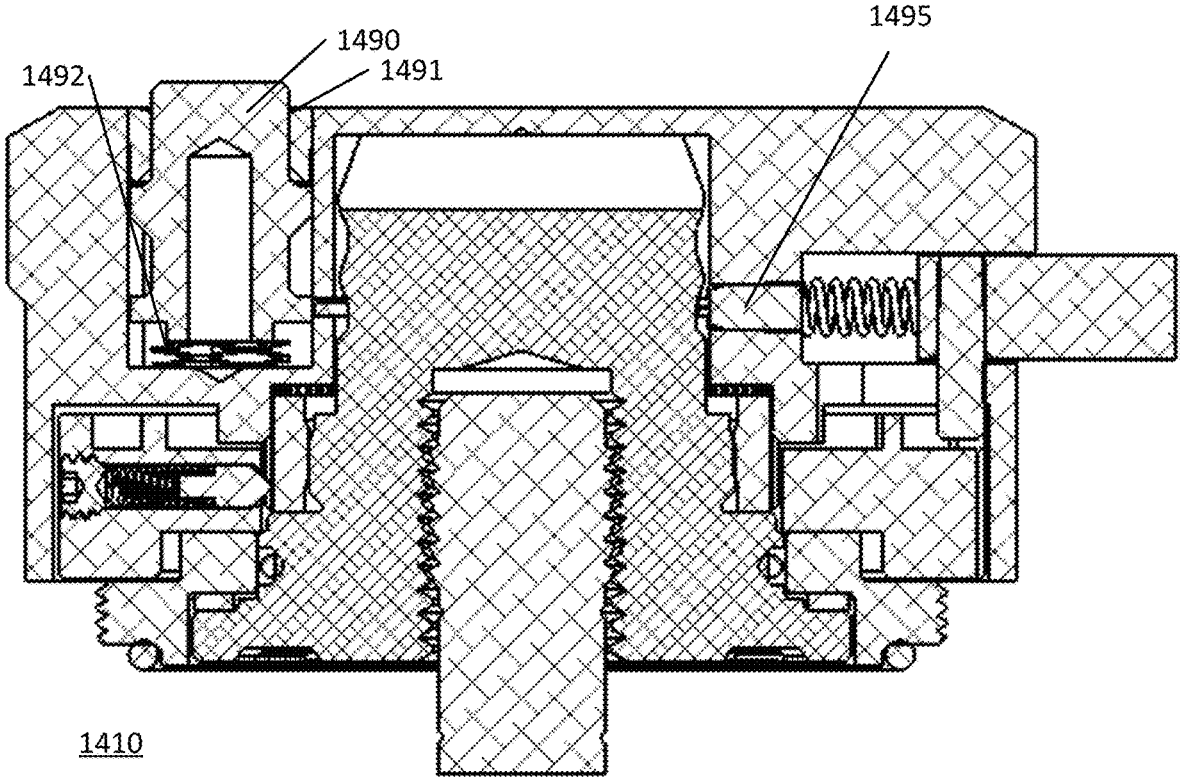
Figure 17C:
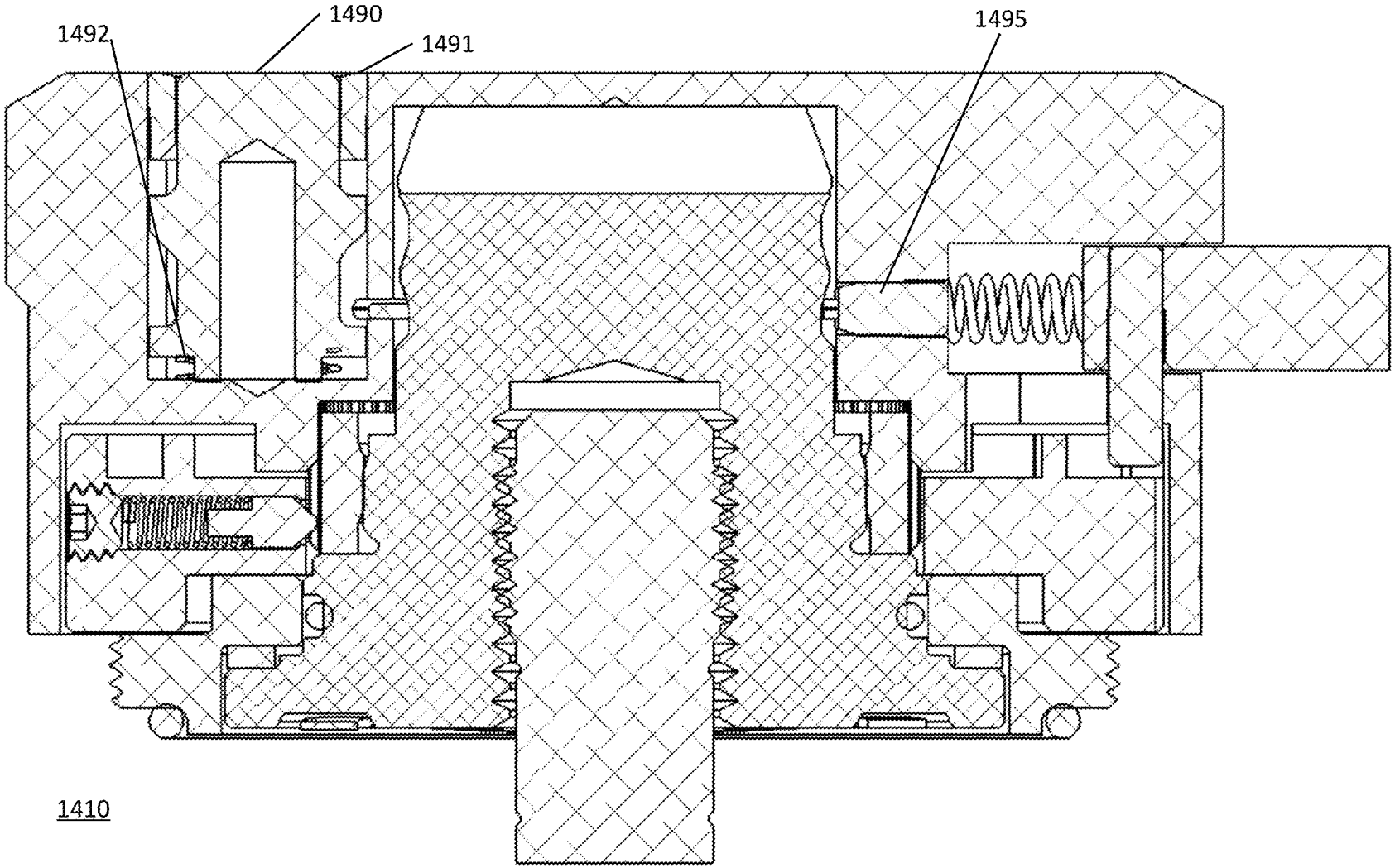
FIG. 17C is a cross-sectional view of the turret assembly of FIG. 17A (taken along section line A-A) in the following condition: in the engaged mode of operation, engagement lock in an unlocked state.
Figure 17D:
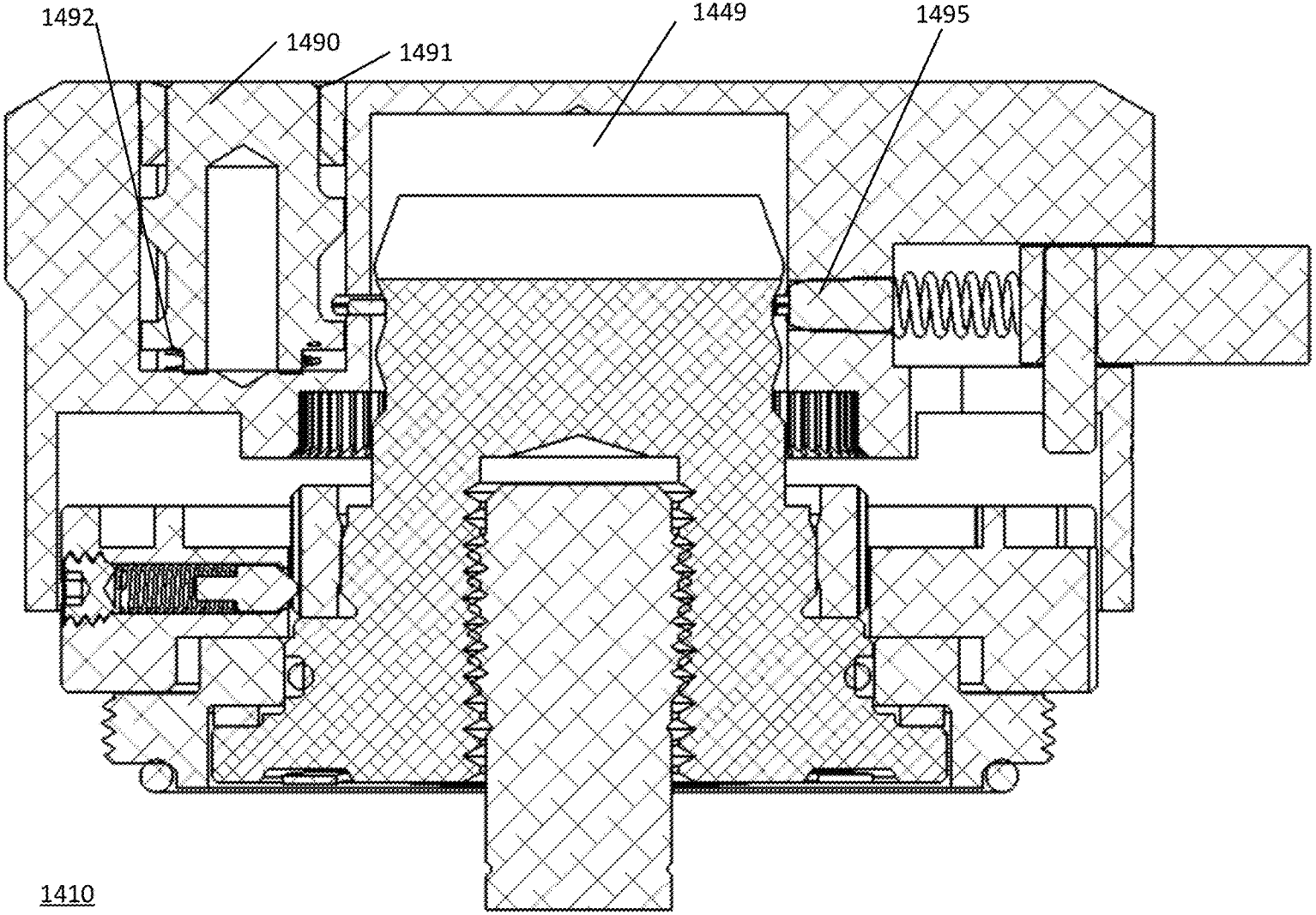
FIG. 17D is a cross-sectional view of the turret assembly of FIG. 17A (taken along section line A-A) in the following condition: in the non-engaged mode of operation, engagement lock in an unlocked state.
Figure 17E:
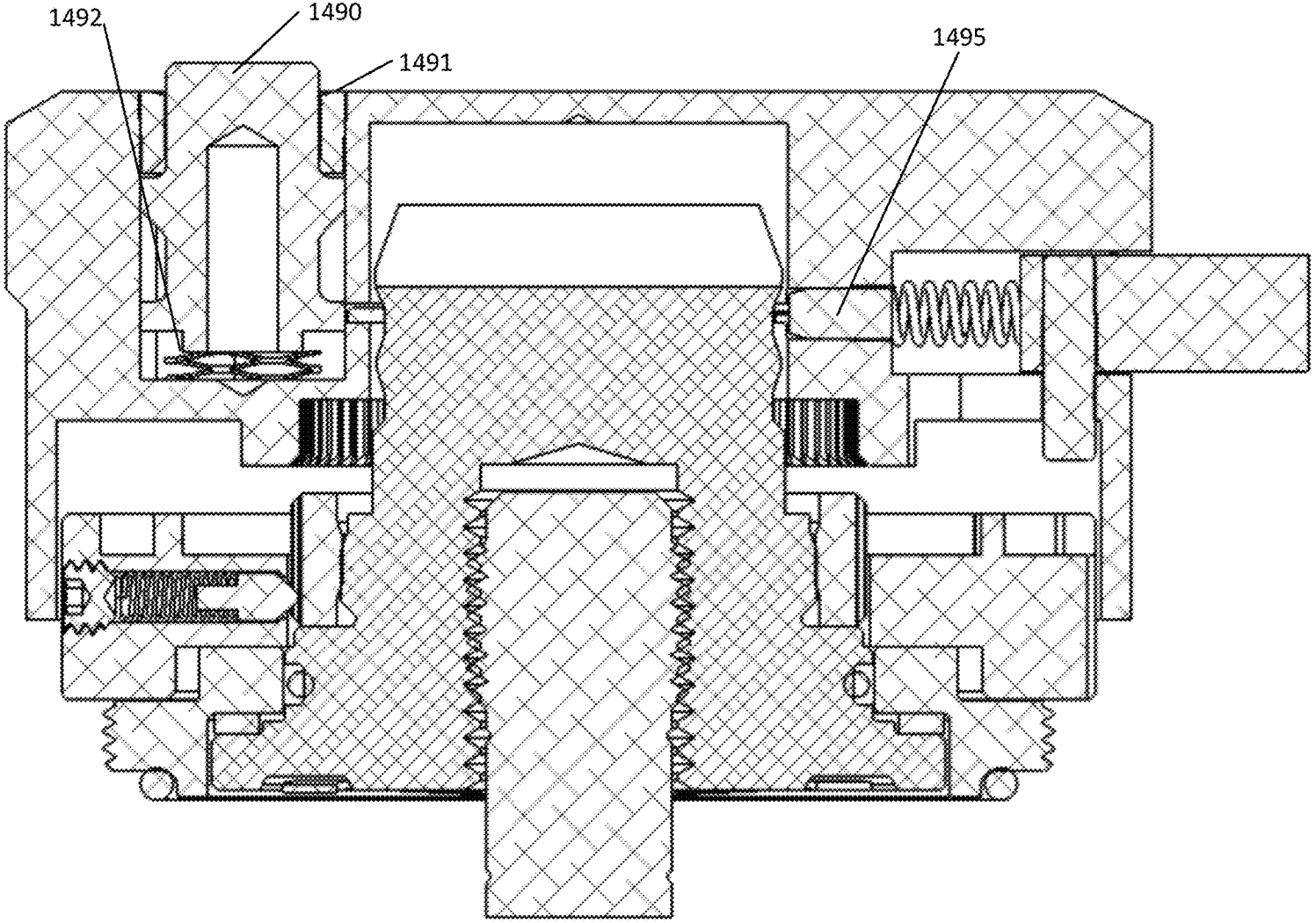
FIG. 17E is a cross-sectional view of the turret assembly of FIG. 17A (taken along section line A-A) in the following condition: in the non-engaged mode of operation, engagement lock in the locked state.

In the condition illustrated in FIG. 17D, the operator can then re-actuate the button 1490 into the position shown in FIG. 17E. In the position illustrated in FIG. 17E, the first rotational device may be rotated relative to the second rotational device. Thus, the possibility of an unintentional re-zero adjustment occurring unintentionally, say during hiking/hunting through thick vegetation, may be reduced as compared to some known turret assemblies.

Referring now to FIG. 17E, an engagement lock may also reduce the possibility of a user prematurely returning the knob assembly 1410 to an engaged mode of operation during a re-zero. In particular, a user may depress the button 1490 to lock the knob assembly 1410 during re-zero operation. This may be advantageous in various applications, such as shooting in a controlled environment such as a range.

Figure 14A:
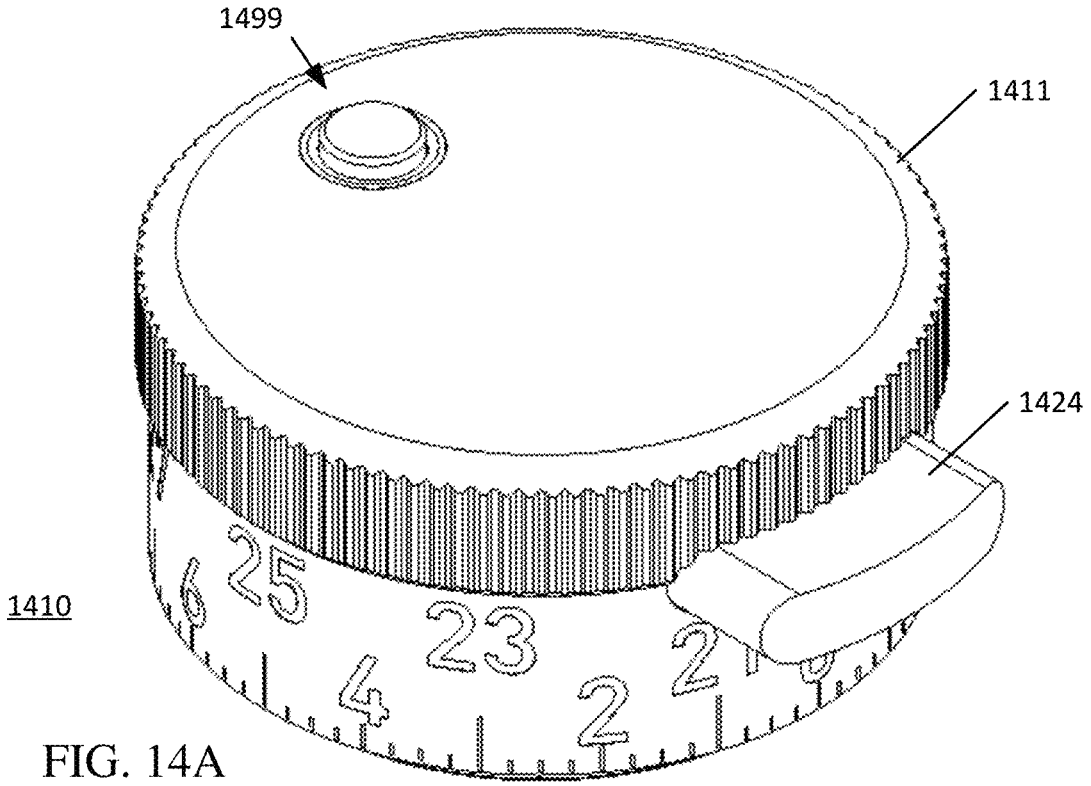
FIGS. 14A and 14B are isometric views of a turret assembly with an engagement lock in the following states, respectively: a locked state and an unlocked state, according to various embodiments.
Figure 14B:
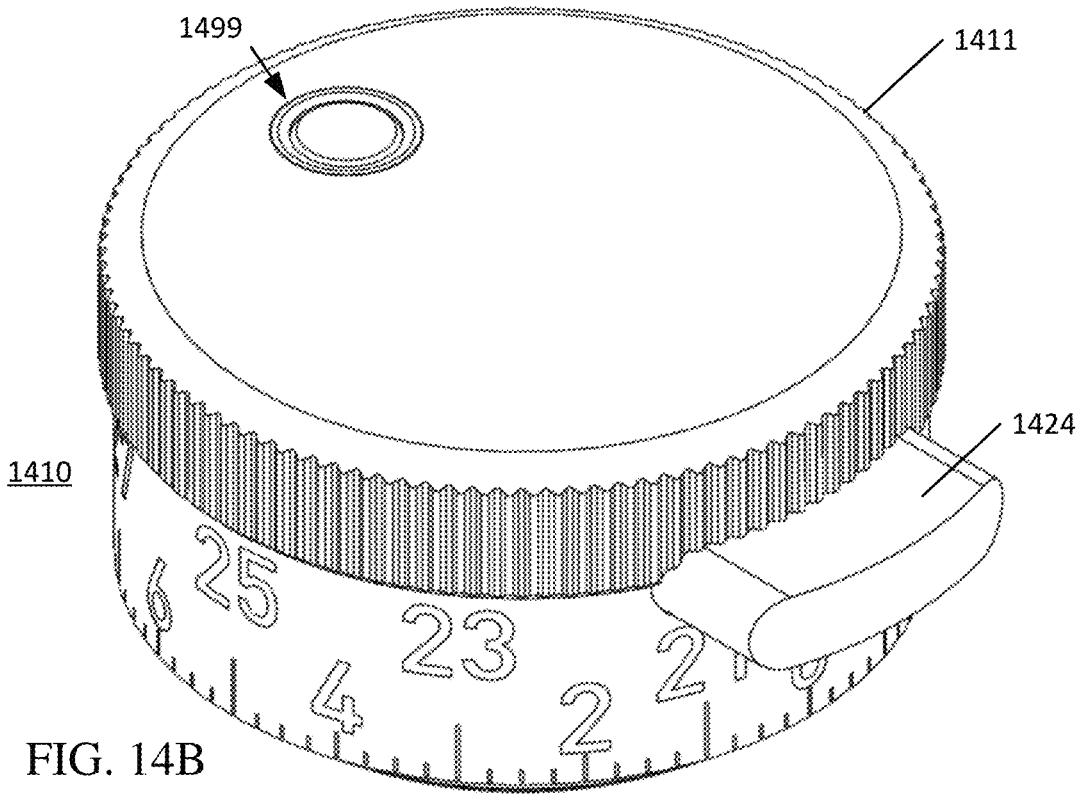
Figure 15:
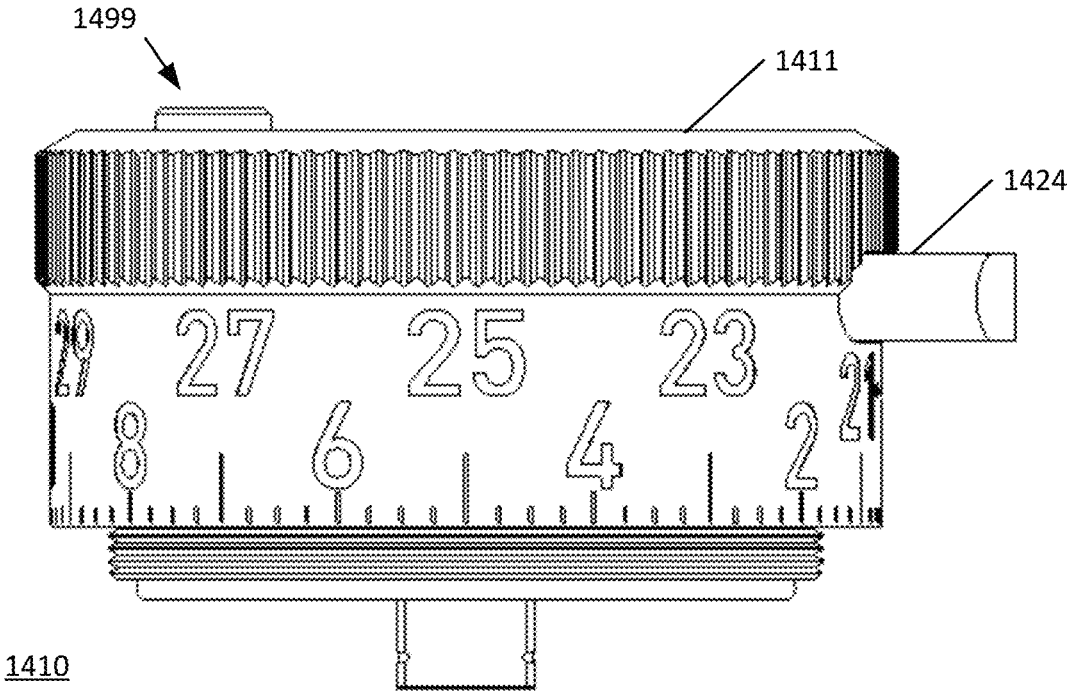
FIG. 15 is a side view of the turret assembly of FIG. 14A, with the engagement lock in the locked state.

FIGS. 14A and 14B are isometric views of a turret assembly 1410 with an engagement lock assembly 1499 in the following states, respectively: a locked state and an unlocked state, according to various embodiments. FIG. 15 is a side view of the turret assembly 1410 of FIG. 14A, with the engagement lock in the locked state.

Referring now to FIG. 14A, the turret assembly 1410 (e.g., an adjustment knob assembly) may be similar to any adjustment knob assemblies described herein in that in may include a dial/knob 1411 or other first rotatable part and a hub (not shown) or other second rotatable part. The first and second rotatable parts may be similar to any dial or hub described herein in that they may be 1) co-rotatable about an axis of rotation in a first mode of operation (e.g., an engaged mode of operation), and not co-rotatable in a second mode of operation (e.g., a non-engaged mode of operation in which the first rotatable part may be rotated about the axis of rotation relative to the second rotatable part). The turret assembly 1410 may include a number of user interfaces, which will be described in turn below.

A first user interface may be actuatable to select a mode of operation of the engaged and non-engaged mode of operation. Referring briefly to FIG. 17D, the first user interface may be actuatable to move one or more parts of the turret assembly 1410 relative to the second rotatable part and/or a housing of an optic. In the illustrated embodiment, the one or more parts includes the first rotatable part 1411. However, in other embodiments, the one or more parts may include some other part(s), such as any gripper described herein, e.g., the gripper 730 (FIG. 11). The gripper 730 (FIG. 11) may move axially together with the clutch release button 710 as can be seen by comparing FIGS. 7 and 9. However, axial movement of one or more parts may not be required in other embodiments-a first user interface may be any user interface now known or later developed for changing a mode of operation of the turret assembly 1410 between the engaged mode of operation (co-rotation of the first and second parts) and the non-engaged mode (rotational movement of the first rotatable part relative to the second rotatable part).

A second user interface of the turret assembly 1410 may include an engagement lock assembly 1499 settable in a plurality of states including a locked state (FIG. 14A) and an unlocked state (FIG. 14B). The engagement lock assembly 1499 may restrict operation of the first user interface. In the illustrated example, the engagement lock assembly 1499 enables the first interface (e.g., does not restrict the first interface) when a depressible button of the engagement lock assembly 1499 is depressed (FIG. 14B).

Accordingly, a sequence of actuations may be utilized to change the mode of operation of the turret assembly 1410 from the engaged state (co-rotation) to the non-engaged state (in which the first rotatable part may be rotated relative to the second rotatable part to re-zero the turret assembly 1410). In the illustrated sequence, an initial actuation (operating the engagement lock assembly 1499) followed by a subsequent actuation (subsequently operating the first interface, such as moving the first rotatable part, in this example, axially relative to the second rotatable part to provide the gap 1449 illustrated in FIGS. 17D and 17E).

Referring again to FIGS. 14A-B, a third user interface of the turret assembly 1410 may include a depressible button 1424. The depressible button 124 may be similar in any respect to depressible button 124 (FIG. 1), or any other user interface now known, or later developed, for restricting rotation of the first rotatable part 1411 described herein. The third interface may not be required in other embodiments.

Figure 16A:
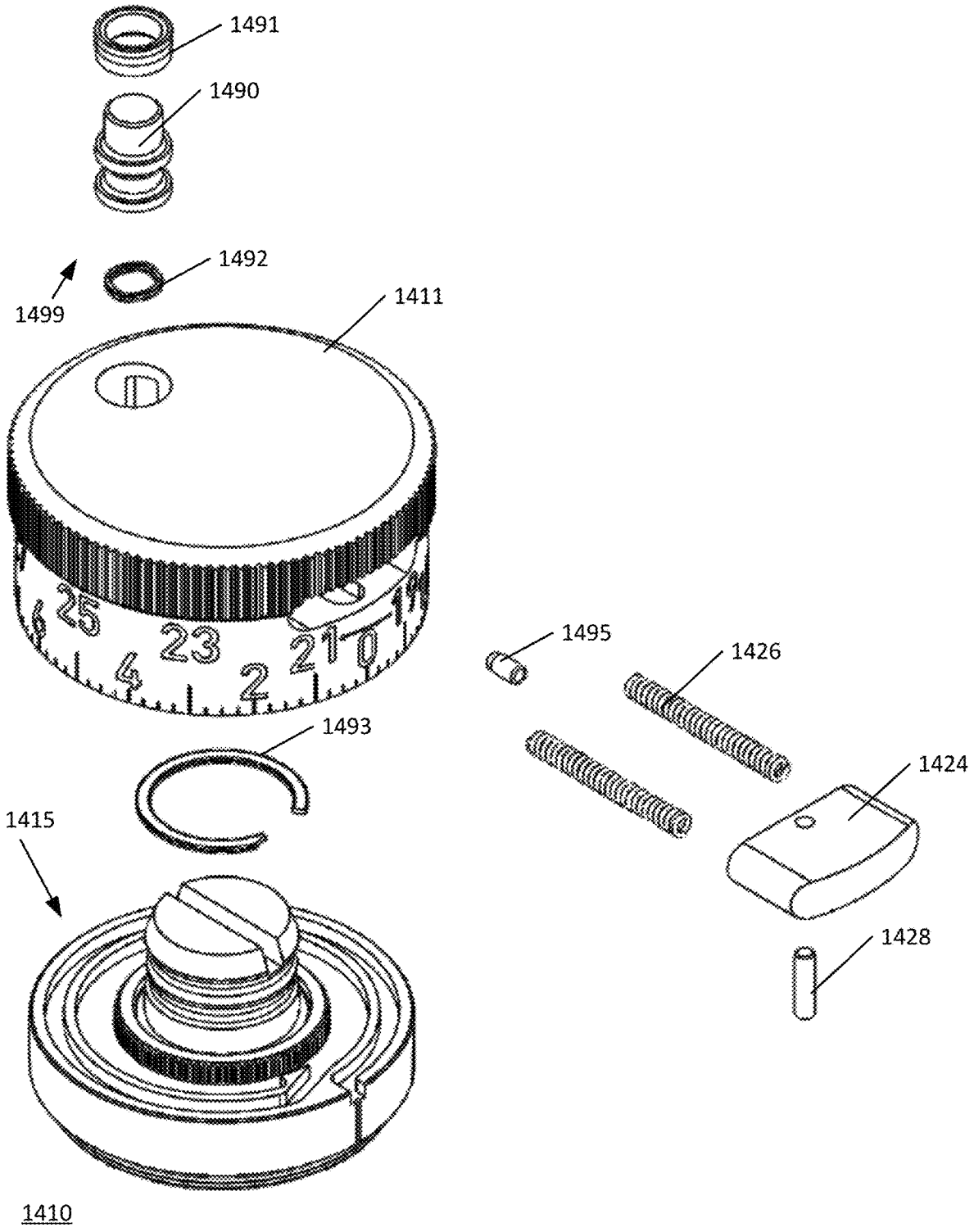
FIG. 16A is an exploded isometric view of the turret assembly of FIG. 14A.
Figure 16B:
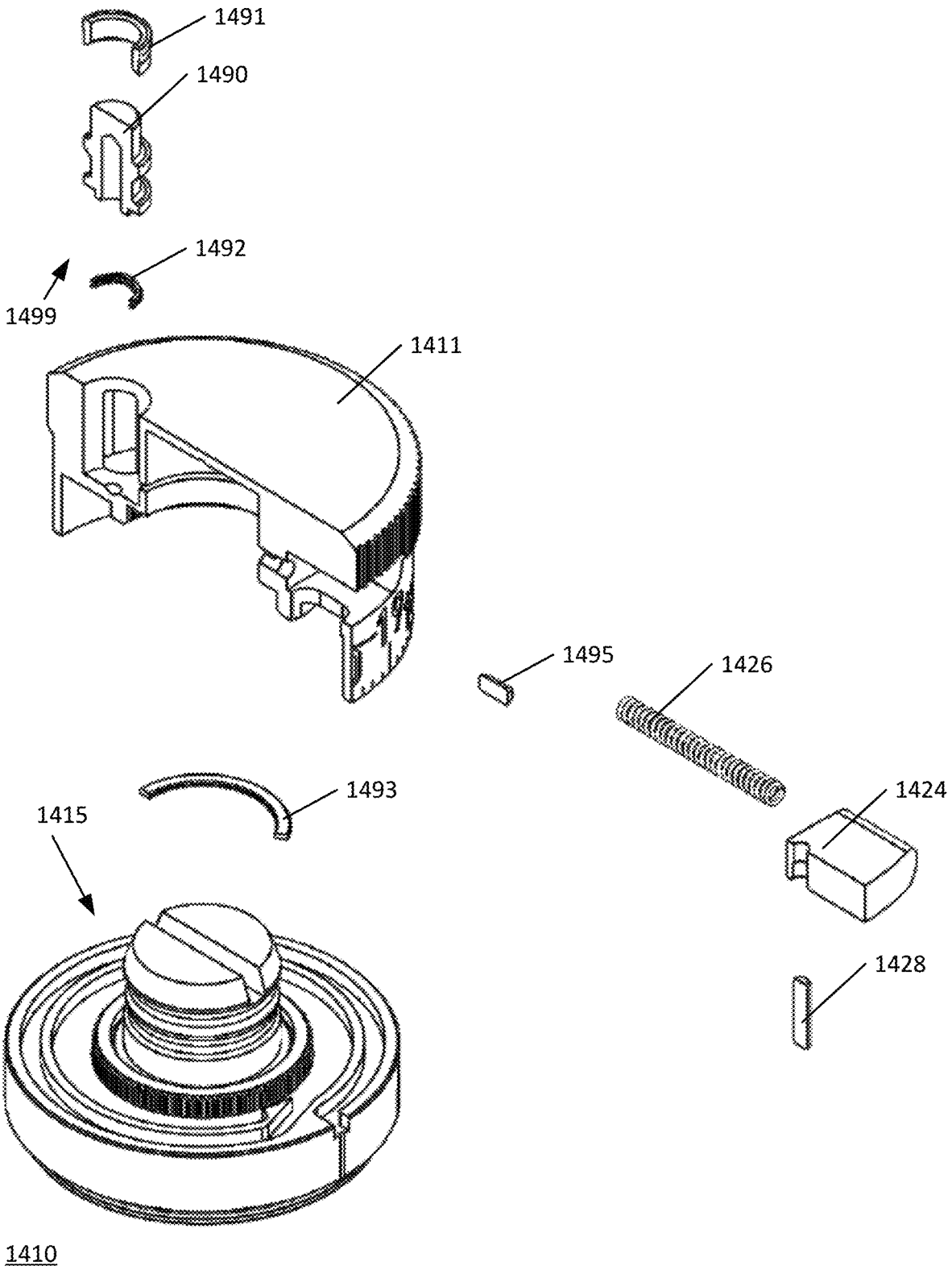
FIG. 16B is a section view of the exploded isometric view of FIG. 16A.

FIG. 16A is an exploded isometric view of the turret assembly 1410 of FIG. 14A. FIG. 16B is a section view of the exploded isometric view of FIG. 16A.

Referring to FIG. 16A, the engagement lock assembly 1499 is received in an opening defined by the first rotatable part 1411. In this embodiment, the engagement lock assembly 1499 includes a depressible button 1490, a stop 1491 (e.g., a retainer), and a biasing element 1492 (which may be spring).

In the illustrated embodiment, the biasing element 1492 is a wave spring, which may minimize the distance between a bottom end of the button 1490 and a bottom of the opening in which the button 1490 is mounted. This may allow the additional functionality of the engagement lock to be added with a minimal increase in form factor (or no increase in form factor, in some examples). In other embodiments, the biasing element 1492 may be some other kind of spring, such as a coil spring. In some embodiments, the biasing element 1492 may be a compressible material that may return into shape after being partially collapsed or otherwise compressed.

In the illustrated embodiment, in which the first rotatable part may move axially relative to the second rotatable part when the first user interface is actuated, the turret assembly 1410 may include another biasing element 1493 (which may be a spring). In the illustrated embodiment, the biasing element 1493, like the biasing element 1492, is a low profile snap-ring. However, in other embodiments, some other type of biasing element may be used.

In other embodiments, some other part(s) may be biased for movement relative to the second rotatable element. Referring again to FIGS. 7 and 9, in these embodiments the gripper 730 is biased using a wave spring 726 having a closed ring shape.

Referring again to FIG. 16A, the biasing element 1493 has an open ring shape. A retainer 1495, such a dowel pin, may maintain orientation of the open ring biasing element 1493. The retainer 1495 may be omitted in embodiments using a closed ring biasing element.

The illustrated embodiment includes a third user interface to restrict rotational movement of the first rotatable part 1411 about the rotational axis. However, other embodiments may include the first and second user interfaces without a third user interface. The third user interface may include a depressible button 1424, one or more springs 1426, and a pin 1428, which may be similar to the corresponding parts in any other embodiment described herein, such as the embodiment of FIG. 1.

Referring again to FIG. 16A, the second rotatable part may be an assembly 1415, which may include a hub similar to any hub or hub assembly described herein, such as the hub 172 (and/or the assembly including the hub) described with reference to FIGS. 3 and 4. In various embodiments, the assembly 1415 may be referred to as a spindle assembly and may include a spindle. In other embodiments, any assembly capable of translating rotational movement to linear movement (to produce linear movement of an optical or electrical element to change a setting of an optical device), now known or later developed, may be used in place of the hub.

FIGS. 17A and 17B are, respectively, a top view and a cross-sectional view (taken along section line AA), respectively, of the turret assembly 1410 of FIG. 14A in the following condition: locked in an engaged mode of operation, engagement lock in the locked state, ready to dial. FIG. 17C is a cross-sectional view of the turret assembly 1410 (taken along section line A-A) in the following condition: in the engaged mode of operation, engagement lock assembly 1499 in an unlocked state. FIG. 17D is a cross-sectional view of the turret assembly 1410 (taken along section line A-A) in the following condition: in the non-engaged mode of operation, engagement lock assembly 1499 in an unlocked state. FIG. 17E is a cross-sectional view of the turret assembly 1410 (taken along section line A-A) in the following condition: in the non-engaged mode of operation, engagement lock assembly 1499 in the locked state.

Referring to FIG. 17B, the illustrated engaged mode of operation provides co-rotation of the first and second rotatable parts. To operate in the non-engaged mode of operation (to re-zero), a user may depress button 1490.

Referring to FIG. 17C, with the button 1490 depressed, the user may move one or more parts in an axial direction relative to the hub (e.g., the user may pull the one or more parts away from the hub). Referring to FIG. 17D, with the one or more parts moved in an axial direction relative to the hub (e.g., pull away, providing the gap 1449 between the first and second rotatable parts), the user may perform a re-zero operation, by rotating the knob relative to the hub.

Referring to FIG. 17E, if the user desires, the user may operate the engagement lock (e.g., actuate the button 1490) to lock the turret assembly 1410 in the non-engaged mode of operation. When locked into the non-engaged mode of operation, the user may continue performing re-zero operations without the possibility of inadvertently returning to the engaged mode of operation (e.g., inadvertently causing axial movement of the knob, in this example).

When a user is finished performing re-zero operations, the user may operate the button 1490 to return the engagement lock to an unlocked state, and then move the knob axially (e.g., downward) to return the turret assembly 1410 to the engaged mode of operation, before operating the button 1490 once again to lock the turret assembly 1410 into the engaged mode of operation.

EXAMPLES

The illustrated embodiments describe some examples within the scope of the disclosure of the present application. However, other embodiments within the scope of this disclosure may include any one of the following examples.

Example 1 is a turret assembly to change an optic device setting, the turret assembly comprising: first and second rotatable parts to rotate together as a unit about an axis of rotation to change the optic device setting; a first user interface actuatable to select a mode of operation of a plurality of different modes of operation, the plurality of different modes of operation including an engaged mode of operation when the first rotatable part is engaged with the second rotatable part to enable co-rotation and a non-engaged mode of operation when the first rotatable part is rotatable relative to the second rotatable part; the turret assembly further including an engagement lock settable in a plurality of states including: a locked state that imparts a restriction on actuation of the first user interface; and an unlocked state that releases the restriction; wherein the engagement lock comprises a second user interface comprising a button or other lock release actuatable to select between the locked and unlocked states.

Example 2 includes the subject matter of example 1, or any other example herein, wherein the engagement lock comprises: an opening defined by a surface of the first rotatable part, wherein the button or other lock release is located in the opening; and a spring or other biasing element to bias the button or other lock release to protrude from the surface in at least one state of the plurality of states.

Example 3 includes the subject matter of any of examples 1-2 or any other example herein, wherein the engagement lock further comprises a stop to retain the button or other lock release in the opening.

Example 4 includes the subject matter of any of examples 1-3 or any other example herein, wherein the engagement lock further comprises a spring or other biasing element to bias the button or other lock release into a position corresponding to the locked state.

Example 5 includes the subject matter of any of examples 1-4 or any other example herein, wherein the engagement lock further comprises a spring or other biasing element at least partially collapsible to set the engagement lock in the unlocked state.

Example 6 includes the subject matter of any of examples 1-5 or any other example herein, wherein the turret assembly further comprising: a plurality of springs or other biasing elements including: a first spring or other biasing element at least partially collapsible by actuation of the first user interface; and a second spring other biasing element that is at least partially collapsible by actuating the button or other lock release.

Example 7 includes the subject matter of any of examples 1-6 or any other example herein, wherein the engagement lock restricts movement of the first spring or other biasing element in the locked state.

Example 8 includes the subject matter of any of examples 1-7 or any other example herein, wherein the second spring or other biasing element comprises a wave spring or a coil spring.

Example 9 includes the subject matter of any of examples 1-8 or any other example herein, wherein the first spring or other biasing element comprises an open ring retention spring or a closed ring retention spring; wherein the apparatus further comprises a third user interface actuatable to restrict rotational movement of the first rotatable part about the axis of rotation, the third user interface including: a button or other lock release; and a third spring or other biasing element.

Example 10 includes the subject matter of any of examples 1-9 or any other example herein, further comprising the open ring retention spring, wherein the turret assembly further comprises a retainer coupled between the button or other lock release of the third interface and the third spring or other biasing element, in a gap defined by the open ring retention spring.

Example 11 includes the subject matter of any of examples 1-10 or any other example herein, further comprising a third user interface comprising a rotation lock settable in a plurality of states including: a locked state that restricts rotation of the first rotatable part around the axis of rotation; and an unlocked state that does not restrict rotation of the first rotatable part around the axis of rotation.

Example 12 includes the subject matter of any of examples 1-11 or any other example herein, wherein the locked state of the third user interface restricts rotational movement of a rotatable assembly including the first rotational part, relative to the axis of rotation, and the locked state of the second user interface restricts linear movement of the rotatable assembly, relative to the second rotational part.

Example 13 includes the subject matter of any of examples 1-12 or any other example herein, wherein the rotatable assembly includes the first rotational part and the engagement lock.

Example 14 includes the subject matter of any of examples 1-13 or any other example herein, wherein actuation of the button or other lock release moves the button or other lock release an axis that is parallel with the axis of rotation.

Example 15 includes the subject matter of any of examples 1-14 or any other example herein, wherein the axis is spaced apart from the axis of rotation.

Example 16 includes the subject matter of any of examples 1-15 or any other example herein, wherein the first user interface is integrally formed with the first rotatable part, wherein the first user interface is comprises a grip defined by an exterior of the first rotatable part.

Example 17 includes the subject matter of any of examples 1-16 or any other example herein, wherein the button or other lock release is carried by the first rotatable part.

Example 18 includes the subject matter of any of examples 1-17 or any other example herein, wherein the optic device setting comprises a setting of the optic device.

Example 19 is firearm, crossbow, air gun, or other ranged device comprising the optic device of any of examples 1-18 or any other example herein.

In any of examples 1-19, or any other example herein, the button or other lock release may be actuatable, to operate the engagement lock, in at least one mode of operation of the plurality of modes of operation. Example 20 is the turret assembly of any of examples 1-19 or any other example herein, wherein button or other lock release may be actuatable, to operate the engagement lock, in more than one mode of operation. For example, wherein the button or other lock release is actuatable, to operate the engagement lock, when the engaged mode of operation is currently selected; and wherein the button or other lock release is also actuatable, to operate the engagement lock, when the non-engaged mode of operation is currently selected.

It will be obvious to those having skill in the art that many changes may be made to the details of the above-described embodiments without departing from the underlying principles of the invention. The scope of the present invention should, therefore, be determined only by the following claims.

The invention claimed is:

1. A turret assembly to change an optic device setting, the turret assembly comprising:

first and second rotatable parts to rotate together as a unit about an axis of rotation to change the optic device setting;

a first user interface actuatable to select a mode of operation of a plurality of different modes of operation, the plurality of different modes of operation including an engaged mode of operation when the first rotatable part is engaged with the second rotatable part to enable co-rotation and a non-engaged mode of operation when the first rotatable part is rotatable relative to the second rotatable part;

the turret assembly further including an engagement lock settable in a plurality of states including:

a locked state that imparts a restriction on actuation of the first user interface; and an unlocked state that releases the restriction;

wherein the engagement lock comprises a second user interface comprising a button or other lock release actuatable to select between the locked and unlocked states.

2. The apparatus of claim 1, wherein the engagement lock comprises:

an opening defined by a surface of the first rotatable part, wherein the button or other lock release is located in the opening; and a spring or other biasing element to bias the button or other lock release to protrude from the surface in at least one state of the plurality of states.

3. The apparatus of claim 1, wherein the engagement lock further comprises a stop to retain the button or other lock release in the opening.

4. The apparatus of claim 1, wherein the engagement lock further comprises a spring or other biasing element to bias the button or other lock release into a position corresponding to the locked state.

5. The apparatus of claim 1, wherein the engagement lock further comprises a spring or other biasing element at least partially collapsible to set the engagement lock in the unlocked state.

6. The apparatus of claim 1, wherein the turret assembly further comprising:

a plurality of springs or other biasing elements including:

a first spring or other biasing element at least partially collapsible by actuation of the first user interface; and a second spring other biasing element that is at least partially collapsible by actuating the button or other lock release.

7. The apparatus of claim 6, wherein the engagement lock restricts movement of the first spring or other biasing element in the locked state.

8. The apparatus of claim 7, wherein the second spring or other biasing element comprises a wave spring or a coil spring.

9. The apparatus of claim 7, wherein the first spring or other biasing element comprises an open ring retention spring or a closed ring retention spring;

wherein the apparatus further comprises a third user interface actuatable to restrict rotational movement of the first rotatable part about the axis of rotation, the third user interface including:

a button or other lock release; and a third spring or other biasing element.

10. The apparatus of claim 9, further comprising the open ring retention spring, wherein the turret assembly further comprises a retainer coupled between the button or other lock release of the third interface and the third spring or other biasing element, in a gap defined by the open ring retention spring.

11. The turret assembly of claim 1, further comprising a third user interface comprising a rotation lock settable in a plurality of states including:

a locked state that restricts rotation of the first rotatable part around the axis of rotation; and an unlocked state that does not restrict rotation of the first rotatable part around the axis of rotation.

12. The turret assembly of claim 11, wherein the locked state of the third user interface restricts rotational movement of a rotatable assembly including the first rotational part, relative to the axis of rotation, and the locked state of the second user interface restricts linear movement of the rotatable assembly, relative to the second rotational part.

13. The turret assembly 12, wherein the rotatable assembly includes the first rotational part and the engagement lock.

14. The apparatus of claim 1, wherein actuation of the button or other lock release moves the button or other lock release an axis that is parallel with the axis of rotation.

15. The apparatus of claim 14, wherein the axis is spaced apart from the axis of rotation.

16. The apparatus of claim 1, wherein the first user interface is integrally formed with the first rotatable part, wherein the first user interface is comprises a grip defined by an exterior of the first rotatable part.

17. The apparatus of claim 1, wherein the button or other lock release is carried by the first rotatable part.

18. An optic device comprising the apparatus of claim 1, wherein the optic device setting comprises a setting of the optic device.

19. A firearm, crossbow, air gun, or other ranged device comprising the optic device of claim 18.

20. An apparatus to change an optic device setting, the apparatus comprising:

first and second rotatable parts to rotate together as a unit about an axis of rotation to change the optic device setting;

a first user interface actuatable to select a mode of operation of a plurality of different modes of operation, the plurality of different modes of operation including an engaged mode of operation when the first rotatable part is engaged with the second rotatable part to enable co-rotation and a non-engaged mode of operation when the first rotatable part is rotatable relative to the second rotatable part;

the turret assembly further including an engagement lock settable in a plurality of states including:

a locked state that imparts a restriction on actuation of the first user interface; and an unlocked state that releases the restriction;

wherein the engagement lock comprises a second user interface comprising a button or other lock release actuatable to select between the locked and unlocked states; and wherein the button or other lock release is actuatable, to operate the engagement lock, when the engaged mode of operation is currently selected; and wherein the button or other lock release is also actuatable, to operate the engagement lock, when the non-engaged mode of operation is currently selected.

* * * * *